US011661749B2

(12) United States Patent
Kell

(10) Patent No.: US 11,661,749 B2
(45) **Date of Patent: *May 30, 2023**

(54) VERTICAL JOINT SYSTEM FOR A SURFACE COVERING PANEL

(71) Applicant: Välinge Innovation AB, Viken (SE)

(72) Inventor: Richard William Kell, North Beach (AU)

(73) Assignee: VALINGE INNOVATION AB, Viken (SE)

( * ) Notice: Subject to any disclaimer, the term of this patent is extended or adjusted under 35 U.S.C. 154(b) by 90 days.

This patent is subject to a terminal disclaimer.

(21) Appl. No.: 17/094,226

(22) Filed: Nov. 10, 2020

(65) Prior Publication Data

US 2021/0214953 A1 Jul. 15, 2021

Related U.S. Application Data

(63) Continuation of application No. 16/699,297, filed on Nov. 29, 2019, now Pat. No. 10,865,571, which is a (Continued)

(30) Foreign Application Priority Data

Aug. 29, 2014 (AU) ..... 2014903452

(51) Int. Cl.
*E04F 15/02* (2006.01)
*E04F 13/08* (2006.01)

(52) U.S. Cl.
CPC .... *E04F 15/02038* (2013.01); *E04F 13/0889* (2013.01); *E04F 15/02033* (2013.01); *E04F 2201/0146* (2013.01)

(58) Field of Classification Search
CPC ..... E04F 15/02038; E04F 13/0889; E04F 15/02033; E04F 2201/0146
See application file for complete search history.

(56) References Cited

U.S. PATENT DOCUMENTS 1,787,027 A 12/1930 Wasleff
3,120,083 A 2/1964 Dahlberg et al.
(Continued)

FOREIGN PATENT DOCUMENTS

DE 2 251 762 5/1974
DE 202 07 844 U 8/2002
(Continued)

OTHER PUBLICATIONS

U.S. Appl. No. 16/713,431, Mats Nilsson and Per Nygren, filed Dec. 13, 2019, (Cited herein as US Patent Application Publication No. 2020/0362567 A1 of Nov. 19, 2020).
(Continued)

*Primary Examiner* — Andrew J Triggs
(74) *Attorney, Agent, or Firm* — Buchanan Ingersoll & Rooney P.C.

(57) ABSTRACT

A vertical joint system for a surface covering panel having an upper and lower surfaces, and a plurality of sides located between the upper and lower surfaces. The joint system has a male part along at least one side and a female part along an opposite side. The female part has a protrusion that extends from the lower surface and an outer most female surface on the protrusion. The male part has a recess that opens onto the lower surface with a portion of the recess forming an inner most male surface. The outer most female surface and the inner most male surface arranged so that when the male part of one surface covering panel is engaged with a female part of a second surface covering panel the outer most female surface overlies the inner most male locking surface at a first location and a second location.

15 Claims, 8 Drawing Sheets

Related U.S. Application Data continuation of application No. 16/392,931, filed on Apr. 24, 2019, now Pat. No. 10,982,449, which is a continuation of application No. 15/507,602, filed as application No. PCT/AU2015/000053 on Aug. 31, 2015, now Pat. No. 10,316,526.

(56) References Cited

U.S. PATENT DOCUMENTS

| | | | |
|---|---|---|---|
| 3,247,638 | A | 4/1966 | Gay et al. |
| 3,538,665 | A | 11/1970 | Gohner |
| 3,694,983 | A | 10/1972 | Couquet |
| 3,720,027 | A | 3/1973 | Christensen |
| 3,742,669 | A | 7/1973 | Mansfeld |
| 3,760,547 | A | 9/1973 | Brenneman |
| 3,857,749 | A | 12/1974 | Yoshida |
| 3,919,820 | A | 11/1975 | Green |
| 4,113,399 | A | 9/1978 | Hansen, Sr. et al. |
| 4,172,169 | A | 10/1979 | Mawson et al. |
| 4,176,210 | A | 11/1979 | Skinner |
| 4,180,615 | A | 12/1979 | Bettoli |
| 4,187,131 | A | 2/1980 | Shortway et al. |
| 4,196,554 | A | 4/1980 | Anderson et al. |
| 4,313,866 | A | 2/1982 | Renshaw |
| 4,333,987 | A | 6/1982 | Kwart et al. |
| 4,393,187 | A | 7/1983 | Boba et al. |
| 4,423,178 | A | 12/1983 | Renshaw |
| 4,426,820 | A | 1/1984 | Terbrack et al. |
| 4,489,115 | A | 12/1984 | Layman et al. |
| 4,507,188 | A | 3/1985 | Chu |
| 4,512,131 | A | 4/1985 | Laramore |
| 4,599,841 | A | 7/1986 | Haid |
| 4,614,680 | A | 9/1986 | Fry et al. |
| 4,772,500 | A | 9/1988 | Stroppiana |
| 4,785,065 | A | 11/1988 | Uhl et al. |
| 4,807,412 | A | 2/1989 | Frederiksen |
| 5,007,222 | A | 4/1991 | Raymond |
| 5,112,671 | A | 5/1992 | Diamond et al. |
| 5,148,850 | A | 9/1992 | Urbanick |
| 5,162,141 | A | 11/1992 | Davey et al. |
| 5,182,892 | A | 2/1993 | Chase |
| 5,344,700 | A | 9/1994 | Mcgath et al. |
| 5,380,794 | A | 1/1995 | Schaefer et al. |
| 5,441,677 | A | 8/1995 | Phillips, Sr. |
| 5,458,953 | A | 10/1995 | Wang et al. |
| 5,465,546 | A | 11/1995 | Buse |
| 5,548,937 | A | 8/1996 | Shimonohara |
| 5,618,602 | A | 4/1997 | Nelson |
| 5,630,304 | A | 5/1997 | Austin |
| 5,670,237 | A | 9/1997 | Shultz et al. |
| 5,694,730 | A | 12/1997 | Del Rincon et al. |
| 5,797,237 | A | 8/1998 | Finkell, Jr. |
| 5,950,389 | A | 9/1999 | Porter |
| 6,006,486 | A | 12/1999 | Moriau et al. |
| 6,052,960 | A | 4/2000 | Yonemura |
| 6,065,262 | A | 5/2000 | Motta |
| 6,101,778 | A | 8/2000 | Martensson |
| 6,139,945 | A | 10/2000 | Krejchi et al. |
| 6,173,548 | B1 | 1/2001 | Hamar et al. |
| 6,182,410 | B1 | 2/2001 | Pervan |
| 6,209,278 | B1 | 4/2001 | Tychsen |
| 6,216,409 | B1 | 4/2001 | Roy et al. |
| 6,233,899 | B1 | 5/2001 | Mellert et al. |
| 6,291,078 | B1 | 9/2001 | Chen et al. |
| 6,324,809 | B1 | 12/2001 | Nelson |
| 6,332,733 | B1 | 12/2001 | Hamberger et al. |
| 6,345,481 | B1 | 2/2002 | Nelson |
| 6,363,677 | B1 | 4/2002 | Chen |
| 6,455,127 | B1 | 9/2002 | Valtanen |
| 6,490,836 | B1 | 12/2002 | Moriau et al. |
| 6,505,452 | B1 | 1/2003 | Hannig |
| 6,536,178 | B1 | 3/2003 | Palsson et al. |
| 6,546,691 | B2 | 4/2003 | Leopolder |
| 6,553,724 | B1 | 4/2003 | Bigler |
| 6,558,070 | B1 | 5/2003 | Valtanen |
| 6,617,009 | B1 | 9/2003 | Chen et al. |
| 6,647,690 | B1 | 11/2003 | Martensson |
| 6,672,030 | B2 | 1/2004 | Schulte |
| 6,675,545 | B2 | 1/2004 | Chen et al. |
| 6,729,091 | B1 | 5/2004 | Martensson |
| 6,761,008 | B2 | 7/2004 | Chen et al. |
| 6,763,643 | B1 | 7/2004 | Martensson |
| 6,766,622 | B1 | 7/2004 | Theirs |
| 6,769,218 | B2 | 8/2004 | Pervan |
| 6,769,219 | B2 | 8/2004 | Schwitte et al. |
| 6,772,568 | B2 | 8/2004 | Thiers |
| 6,790,512 | B2 | 9/2004 | Macqueen et al. |
| 6,804,926 | B1 | 10/2004 | Eisermann |
| 6,851,241 | B2 | 2/2005 | Pervan |
| 6,854,235 | B2 | 2/2005 | Martensson |
| 6,862,857 | B2 | 3/2005 | Tychsen |
| 6,865,855 | B2 | 3/2005 | Knauseder |
| 6,874,292 | B2 | 4/2005 | Moriau |
| 6,880,307 | B2 | 4/2005 | Schwitte |
| 6,895,881 | B1 | 5/2005 | Whitaker |
| 6,928,779 | B2 | 8/2005 | Moriau et al. |
| 6,986,934 | B2 | 1/2006 | Chen et al. |
| 7,051,486 | B2 | 5/2006 | Pervan |
| 7,090,430 | B1 | 8/2006 | Fletcher |
| 7,121,058 | B2 | 10/2006 | Palsson et al. |
| 7,155,871 | B1 | 1/2007 | Stone et al. |
| 7,169,460 | B1 | 1/2007 | Chen et al. |
| 7,171,791 | B2 | 2/2007 | Pervan |
| 7,211,310 | B2 | 5/2007 | Chen et al. |
| 7,251,916 | B2 | 8/2007 | Konzelmann et al. |
| 7,275,350 | B2 | 10/2007 | Pervan et al. |
| 7,337,588 | B1 | 3/2008 | Moebus |
| 7,377,081 | B2 | 5/2008 | Ruhdorfer |
| 7,398,625 | B2 | 7/2008 | Pervan |
| 7,419,717 | B2 | 9/2008 | Chen et al. |
| 7,451,578 | B2 | 11/2008 | Hannig |
| 7,454,875 | B2 | 11/2008 | Pervan et al. |
| 7,484,337 | B2 | 2/2009 | Hecht |
| 7,552,568 | B2 | 6/2009 | Palsson et al. |
| 7,568,322 | B2 | 8/2009 | Pervan et al. |
| 7,584,583 | B2 | 9/2009 | Bergelin et al. |
| 7,603,826 | B1 | 10/2009 | Moebus |
| 7,607,271 | B2 | 10/2009 | Griffin et al. |
| 7,614,197 | B2 | 11/2009 | Nelson |
| 7,617,645 | B2 | 11/2009 | Moriau et al. |
| 7,621,094 | B2 | 11/2009 | Moriau et al. |
| 7,634,886 | B2 | 12/2009 | Moriau et al. |
| 7,634,887 | B2 | 12/2009 | Moriau et al. |
| 7,637,066 | B2 | 12/2009 | Moriau et al. |
| 7,640,708 | B2 | 1/2010 | Moriau et al. |
| 7,644,555 | B2 | 1/2010 | Moriau et al. |
| 7,644,557 | B2 | 1/2010 | Moriau et al. |
| 7,647,743 | B2 | 1/2010 | Moriau et al. |
| 7,650,728 | B2 | 1/2010 | Moriau et al. |
| 7,654,054 | B2 | 2/2010 | Moriau et al. |
| 7,658,048 | B2 | 2/2010 | Moriau et al. |
| 7,677,001 | B2 | 3/2010 | Pervan |
| 7,678,215 | B2 | 3/2010 | Martin |
| 7,716,896 | B2 | 5/2010 | Pervan |
| 7,739,849 | B2 | 6/2010 | Pervan |
| 7,763,345 | B2 | 7/2010 | Chen et al. |
| 7,779,597 | B2 | 8/2010 | Thiers et al. |
| 7,802,415 | B2 | 9/2010 | Pervan |
| 7,841,144 | B2 | 11/2010 | Pervan |
| 7,841,150 | B2 | 11/2010 | Pervan |
| 7,856,784 | B2 | 12/2010 | Martensson |
| 7,856,789 | B2 | 12/2010 | Eisermann |
| 7,861,482 | B2 | 1/2011 | Pervan |
| 7,866,110 | B2 | 1/2011 | Pervan |
| 7,886,497 | B2 | 2/2011 | Pervan et al. |
| 7,896,571 | B1 | 3/2011 | Hannig et al. |
| 7,930,862 | B2 | 4/2011 | Bergelin et al. |
| 7,958,689 | B2 | 6/2011 | Lei |
| 7,980,043 | B2 | 7/2011 | Moebus |
| 7,984,600 | B2 | 7/2011 | Alford et al. |
| 8,006,460 | B2 | 8/2011 | Chen et al. |
| 8,021,741 | B2 | 9/2011 | Chen et al. |
| 8,028,486 | B2 | 10/2011 | Pervan |
| 8,037,656 | B2 | 10/2011 | Liu |

(56) References Cited

U.S. PATENT DOCUMENTS 8,038,363 B2 10/2011 Hannig
8,042,311 B2 10/2011 Pervan et al.
8,071,193 B2 12/2011 Windmöller
8,091,238 B2 1/2012 Hannig et al.
8,099,924 B2 1/2012 Braun
8,112,891 B2 2/2012 Pervan
8,132,384 B2 3/2012 Hannig
8,166,718 B2 5/2012 Liu
8,191,333 B2 6/2012 Braun
8,196,366 B2 6/2012 Thiers
8,215,078 B2 7/2012 Pervan
8,234,829 B2 8/2012 Thiers et al.
8,245,478 B2 8/2012 Bergelin et al.
8,281,549 B2 10/2012 Du
8,293,058 B2 10/2012 Pervan et al.
8,353,140 B2 1/2013 Pervan et al.
8,356,452 B2 1/2013 Thiers et al.
8,365,499 B2 2/2013 Nilsson et al.
8,375,672 B2 2/2013 Hannig
8,375,674 B2 2/2013 Braun
8,480,841 B2 7/2013 Pervan et al.
8,484,924 B2 7/2013 Braun
8,490,361 B2 7/2013 Curry et al.
8,499,521 B2 8/2013 Pervan et al.
8,511,031 B2 8/2013 Bergelin et al.
8,544,231 B2 10/2013 Hannig
8,544,232 B2 10/2013 Wybo et al.
8,544,234 B2 10/2013 Pervan et al.
8,584,423 B2 11/2013 Pervan et al.
8,613,826 B2 12/2013 Pervan et al.
8,658,274 B2 2/2014 Chen et al.
8,707,651 B2 4/2014 Stockl
8,720,149 B2 5/2014 Bossuyt
8,726,604 B2 5/2014 Hannig
8,745,952 B2 6/2014 Perra et al.
8,756,899 B2 6/2014 Nilsson et al.
8,763,340 B2 7/2014 Pervan et al.
8,800,150 B2 8/2014 Pervan
8,806,832 B2 8/2014 Kell
8,833,028 B2 9/2014 Whispell et al.
8,834,992 B2 9/2014 Chen et al.
8,952,078 B2 2/2015 Gould
8,966,853 B2 3/2015 Hannig
8,978,336 B2 3/2015 Perra
9,103,126 B2 8/2015 Kell
9,212,492 B2 12/2015 Pervan et al.
9,217,250 B2 12/2015 Perra
9,222,267 B2 12/2015 Bergelin et al.
9,228,360 B2 1/2016 Schneider
9,249,581 B2 2/2016 Nilsson et al.
9,260,870 B2 2/2016 Vermeulen et al.
9,296,191 B2 3/2016 Pervan et al.
9,314,936 B2 4/2016 Pervan
9,371,653 B2 6/2016 Liu
9,410,328 B2 8/2016 Pervan
9,528,278 B2 12/2016 Cappelle
9,650,792 B2 5/2017 Ramachandra
9,695,600 B2 7/2017 Vandervoorde
9,695,601 B2 7/2017 Whispell et al.
9,695,851 B2 7/2017 Hanning
9,714,515 B2 7/2017 Pervan
9,745,758 B2 8/2017 Baert et al.
9,765,530 B2 9/2017 Bergelin et al.
9,777,487 B2 10/2017 Pervan et al.
9,803,374 B2 10/2017 Pervan
9,816,270 B2 11/2017 Pervan et al.
9,874,035 B2 1/2018 Wagner
9,885,186 B2 2/2018 Liu
9,885,187 B2 2/2018 Kell
10,000,935 B2 6/2018 Kell
10,047,527 B2 8/2018 Nilsson et al.
10,059,084 B2 8/2018 Lundblad et al.
10,113,318 B2 10/2018 Cappelle
10,137,659 B2 11/2018 Pervan
10,214,917 B2 2/2019 Pervan et al.
10,287,777 B2 5/2019 Boo et al.
10,301,830 B2 5/2019 Boo
10,316,526 B2 6/2019 Kell
10,344,379 B2 7/2019 Pervan
10,407,919 B2 9/2019 Boo
10,450,760 B2 10/2019 Bergelin et al.
10,486,399 B2 11/2019 Chen et al.
10,493,731 B2 12/2019 Lundblad et al.
10,526,793 B2 1/2020 Nilsson et al.
10,704,269 B2 7/2020 Whispell et al.
10,780,676 B2 9/2020 Lundblad et al.
10,808,410 B2 10/2020 Boo et al.
10,837,181 B2 11/2020 Josefsson et al.
10,844,612 B2 11/2020 Boo
10,851,549 B2 12/2020 Boo
10,865,571 B2 12/2020 Kell
10,975,580 B2 4/2021 Pervan et al.
10,982,449 B2 4/2021 Kell
11,066,836 B2 7/2021 Bergelin et al.
2001/0021431 A1 9/2001 Chen
2002/0007606 A1 1/2002 Kettler
2002/0007608 A1 1/2002 Pervan
2002/0007609 A1 1/2002 Pervan
2002/0031646 A1 3/2002 Chen
2002/0069611 A1 6/2002 Leopolder
2002/0092263 A1 7/2002 Schulte
2002/0142135 A1 10/2002 Chen et al.
2002/0152707 A1 10/2002 Martensson
2002/0170258 A1 11/2002 Schwitte et al.
2002/0178674 A1 12/2002 Pervan
2002/0178681 A1 12/2002 Zancai
2002/0189183 A1 12/2002 Ricciardelli
2003/0009971 A1 1/2003 Palmberg
2003/0024199 A1 2/2003 Pervan
2003/0024200 A1 2/2003 Moriau et al.
2003/0037504 A1 2/2003 Schwitte et al.
2003/0041545 A1 3/2003 Stanchfield
2003/0101674 A1 6/2003 Pervan et al.
2003/0101681 A1 6/2003 Tychsen
2003/0110720 A1 6/2003 Berard et al.
2003/0180091 A1 9/2003 Stridsman
2003/0188504 A1 10/2003 Eisermann
2003/0196405 A1 10/2003 Pervan
2003/0224147 A1 12/2003 Maine et al.
2004/0031225 A1 2/2004 Fowler
2004/0031227 A1 2/2004 Knauseder
2004/0060255 A1 4/2004 Knauseder
2004/0068954 A1 4/2004 Martensson
2004/0128934 A1 7/2004 Hecht
2004/0137180 A1 7/2004 Sjoberg et al.
2004/0139678 A1 7/2004 Pervan
2004/0177584 A1 9/2004 Pervan
2004/0182036 A1 9/2004 Sjoberg et al.
2004/0206036 A1 10/2004 Pervan
2004/0211143 A1 10/2004 Hannig
2004/0211144 A1 10/2004 Stanchfield
2004/0219339 A1 11/2004 Dempsey et al.
2004/0241374 A1 12/2004 Thiers
2004/0255538 A1 12/2004 Ruhdorfer
2004/0255541 A1 12/2004 Thiers et al.
2004/0261348 A1 12/2004 Vulin
2005/0003160 A1 1/2005 Chen et al.
2005/0028474 A1 2/2005 Kim
2005/0112320 A1 5/2005 Wright
2005/0138881 A1 6/2005 Pervan
2005/0144881 A1 7/2005 Tate et al.
2005/0166514 A1 8/2005 Pervan
2005/0176321 A1 8/2005 Crette et al.
2005/0021081 A1 9/2005 Pervan
2005/0193677 A1 9/2005 Vogel
2005/0208255 A1 9/2005 Pervan
2005/0221073 A1 10/2005 Liou
2005/0235593 A1 10/2005 Hecht
2005/0247000 A1 11/2005 Zhu
2005/0250921 A1 11/2005 Qiu et al.
2005/0252130 A1 11/2005 Martensson
2005/0268570 A2 12/2005 Pervan
2006/0010820 A1 1/2006 Schwitte
2006/0032168 A1 2/2006 Thiers et al.

(56) References Cited

U.S. PATENT DOCUMENTS

2006/0032175 A1 2/2006 Chen et al.
2006/0053724 A1 3/2006 Braun et al.
2006/0070333 A1 4/2006 Pervan
2006/0101769 A1 5/2006 Pervan et al.
2006/0154015 A1 7/2006 Miller et al.
2006/0156666 A1 7/2006 Caufield
2006/0174974 A1 8/2006 Brannstrom et al.
2006/0225377 A1 10/2006 Moriau et al.
2006/0236642 A1 10/2006 Pervan
2006/0248830 A1 11/2006 Moriau et al.
2006/0248831 A1 11/2006 Moriau et al.
2006/0260252 A1 11/2006 Brice
2006/0260254 A1 11/2006 Pervan
2007/0006543 A1 1/2007 Engstrom
2007/0011981 A1 1/2007 Eiserman
2007/0022694 A1 2/2007 Chen et al.
2007/0028547 A1 2/2007 Grafenauer et al.
2007/0094986 A1 5/2007 Moriau et al.
2007/0094987 A1 5/2007 Moriau et al.
2007/0130872 A1 6/2007 Goodwin
2007/0151189 A1 7/2007 Yang
2007/0151191 A1 7/2007 August
2007/0154840 A1 7/2007 Thies et al.
2007/0175148 A1 8/2007 Bergelin et al.
2007/0175156 A1 8/2007 Pervan et al.
2007/0184230 A1 8/2007 Verrue et al.
2007/0193178 A1 8/2007 Groeke et al.
2007/0196624 A1 8/2007 Chen et al.
2007/0218252 A1 9/2007 Donald
2007/0275207 A1 11/2007 Higgins et al.
2008/0000182 A1 1/2008 Pervan
2008/0000183 A1 1/2008 Bergelin et al.
2008/0000186 A1 1/2008 Pervan et al.
2008/0000188 A1 1/2008 Pervan
2008/0010931 A1 1/2008 Pervan et al.
2008/0010937 A1 1/2008 Pervan
2008/0028707 A1 2/2008 Pervan
2008/0028713 A1 2/2008 Pervan
2008/0029490 A1 2/2008 Martin, Jr. et al.
2008/0034701 A1 2/2008 Pervan
2008/0034708 A1 2/2008 Pervan
2008/0041007 A1 2/2008 Pervan
2008/0053028 A1 3/2008 Moriau et al.
2008/0060309 A1 3/2008 Moriau et al.
2008/0060310 A1 3/2008 Moriau et al.
2008/0092473 A1 4/2008 Heyns
2008/0104921 A1 5/2008 Pervan et al.
2008/0110125 A1 5/2008 Pervan
2008/0014161 A1 6/2008 Thiers
2008/0134607 A1 6/2008 Pervan
2008/0134613 A1 6/2008 Pervan
2008/0134614 A1 6/2008 Pervan
2008/0138560 A1 6/2008 Windmöller
2008/0148674 A1 6/2008 Thiers et al.
2008/0153609 A1 6/2008 Kotler
2008/0172971 A1 7/2008 Pervan
2008/0184646 A1 8/2008 Alford
2008/0241440 A1 10/2008 Bauer
2008/0256890 A1 10/2008 Pervan
2008/0311355 A1 12/2008 Chen et al.
2009/0031662 A1 2/2009 Chen et al.
2009/0038253 A1 2/2009 Martensson
2009/0049787 A1 2/2009 Hannig
2009/0110888 A1 4/2009 Wuest et al.
2009/0133353 A1 5/2009 Pervan et al.
2009/0151290 A1 6/2009 Liu
2009/0159156 A1 6/2009 Walker
2009/0186710 A1 7/2009 Joseph
2009/0193748 A1 8/2009 Boo
2009/0217611 A1 9/2009 Schrader
2009/0223162 A1 9/2009 Chen et al.
2009/0226662 A1 9/2009 Dyczko-Riglin et al.
2009/0235604 A1 9/2009 Cheng et al.
2009/0249733 A1 10/2009 Moebus
2009/0260313 A1 10/2009 Segaert
2009/0272058 A1 11/2009 Duselis et al.
2009/0320402 A1 12/2009 Schacht et al.
2010/0011695 A1 1/2010 Cheng
2010/0018149 A1 1/2010 Thiers
2010/0031594 A1 2/2010 Liu
2010/0043333 A1 2/2010 Hannig et al.
2010/0058702 A1 3/2010 Lei
2010/0260962 A1 10/2010 Chen et al.
2010/0293879 A1 11/2010 Pervan et al.
2010/0300029 A1 12/2010 Braun et al.
2010/0319293 A1 12/2010 Dammers et al.
2011/0001420 A1 1/2011 Tchakarov et al.
2011/0008567 A1 1/2011 Weeks et al.
2011/0030303 A1 2/2011 Pervan et al.
2011/0041996 A1 2/2011 Pervan
2011/0056167 A1 3/2011 Nilsson et al.
2011/0094178 A1 4/2011 Braun
2011/0131901 A1 6/2011 Pervan et al.
2011/0131909 A1 6/2011 Hannig
2011/0138722 A1 6/2011 Hannig
2011/0146177 A1 6/2011 Hannig
2011/0154763 A1 6/2011 Bergelin et al.
2011/0167744 A1 7/2011 Whispell et al.
2011/0173914 A1 7/2011 Engstrom
2011/0247285 A1 10/2011 Wybo
2011/0247748 A1 10/2011 Pervan et al.
2011/0258959 A1 10/2011 Braun
2011/0296780 A1 12/2011 Windmöller
2012/0003439 A1 1/2012 Chen et al.
2012/0017534 A1 1/2012 Oh
2012/0040149 A1 2/2012 Chen et al.
2012/0066996 A1 3/2012 Konstanczak
2012/0067461 A1 3/2012 Braun
2012/0124932 A1 5/2012 Schulte et al.
2012/0137617 A1 6/2012 Pervan
2012/0174519 A1 7/2012 Schulte
2012/0174521 A1 7/2012 Schulte
2012/0180416 A1 7/2012 Perra et al.
2012/0192521 A1 8/2012 Schulte
2012/0216472 A1 8/2012 Martensson
2012/0266555 A1 10/2012 Cappelle
2012/0276369 A1 11/2012 Jing et al.
2012/0279154 A1 11/2012 Bergelin et al.
2012/0304581 A1 12/2012 Kim
2013/0008118 A1 1/2013 Baert et al.
2013/0014890 A1 1/2013 Pervan et al.
2013/0025964 A1 1/2013 Ramachandra et al.
2013/0042563 A1 2/2013 Pervan et al.
2013/0042565 A1 2/2013 Pervan et al.
2013/0047536 A1 2/2013 Pervan
2013/0097959 A1 4/2013 Michel
2013/0111758 A1 5/2013 Nilsson et al.
2013/0152492 A1 6/2013 Whitaker
2013/0160391 A1 6/2013 Pervan et al.
2013/0174507 A1 7/2013 Oehrlein
2013/0212971 A1 8/2013 Cordeiro
2013/0243996 A1 9/2013 Hannig
2013/0269863 A1 10/2013 Pervan et al.
2013/0283719 A1 10/2013 Döhring et al.
2013/0298487 A1 11/2013 Bergelin et al.
2013/0305650 A1 11/2013 Liu
2013/0309441 A1 11/2013 Hannig
2013/0333182 A1 12/2013 Pervan et al.
2014/0007539 A1 1/2014 Pervan et al.
2014/0033633 A1 2/2014 Kell
2014/0033635 A1 2/2014 Pervan et al.
2014/0069043 A1 3/2014 Pervan
2014/0069044 A1 3/2014 Wallin
2014/0115994 A1 5/2014 Pervan
2014/0186104 A1 7/2014 Hamberger
2014/0215946 A1 8/2014 Roy et al.
2014/0237924 A1 8/2014 Nilsson et al.
2014/0283466 A1 9/2014 Boo
2014/0283477 A1 9/2014 Hannig
2014/0290173 A1 10/2014 Hamberger
2014/0318061 A1 10/2014 Pervan
2014/0325930 A1 11/2014 Schneider
2014/0352248 A1 12/2014 Whispell et al.
2014/0356594 A1 12/2014 Chen et al.

(56) References Cited

U.S. PATENT DOCUMENTS

| | | | |
|---|---|---|---|
| 2014/0366476 | A1 | 12/2014 | Pervan |
| 2014/0366477 | A1 | 12/2014 | Kell |
| 2015/0114552 | A1 | 4/2015 | Cernohous et al. |
| 2015/0225964 | A1 | 8/2015 | Chen et al. |
| 2015/0252573 | A1 | 9/2015 | Devos |
| 2015/0330088 | A1 | 11/2015 | Derelöv |
| 2015/0368910 | A1 | 12/2015 | Kell |
| 2016/0016390 | A1 | 1/2016 | Lundblad et al. |
| 2016/0016391 | A1 | 1/2016 | Lundblad et al. |
| 2016/0047129 | A1 | 2/2016 | Bowers |
| 2016/0052245 | A1 | 2/2016 | Chen et al. |
| 2016/0069089 | A1 | 3/2016 | Bergelin et al. |
| 2016/0076260 | A1 | 3/2016 | Pervan et al. |
| 2016/0108624 | A1 | 4/2016 | Nilsson et al. |
| 2016/0115695 | A1 | 4/2016 | Devos |
| 2016/0138274 | A1 | 5/2016 | Anspach et al. |
| 2016/0186318 | A1 | 6/2016 | Pervan et al. |
| 2016/0194883 | A1 | 7/2016 | Pervan |
| 2016/0194885 | A1 | 7/2016 | Whispell et al. |
| 2016/0201324 | A1 | 7/2016 | Håkansson et al. |
| 2016/0265234 | A1 | 9/2016 | Pervan |
| 2016/0333595 | A1 | 11/2016 | Cappelle |
| 2016/0375674 | A1 | 12/2016 | Schulte |
| 2017/0030088 | A1 | 2/2017 | Simoens |
| 2017/0037642 | A1 | 2/2017 | Boo |
| 2017/0037645 | A1 | 2/2017 | Pervan |
| 2017/0175400 | A1 | 6/2017 | Joseffson et al. |
| 2017/0241136 | A1 | 8/2017 | Kell |
| 2017/0350140 | A1 | 12/2017 | Bergelin et al. |
| 2017/0362834 | A1 | 12/2017 | Pervan et al. |
| 2017/0370109 | A1 | 12/2017 | Devos |
| 2018/0010342 | A1 | 1/2018 | Van Hooydonck |
| 2018/0094441 | A1 | 4/2018 | Boo et al. |
| 2018/0313093 | A1 | 11/2018 | Nilsson et al. |
| 2019/0017278 | A1 | 1/2019 | De Rick et al. |
| 2019/0091977 | A1 | 3/2019 | Lundblad et al. |
| 2019/0136545 | A1 | 5/2019 | De Rick et al. |
| 2019/0211569 | A1 | 7/2019 | Boo et al. |
| 2019/0249444 | A1 | 8/2019 | Kell |
| 2019/0277041 | A1 | 9/2019 | Pervan et al. |
| 2019/0394314 | A1 | 12/2019 | Pervan et al. |
| 2020/0056379 | A1 | 2/2020 | Boo |
| 2020/0063441 | A1 | 2/2020 | Boo |
| 2020/0180282 | A1 | 6/2020 | Lundblad et al. |
| 2020/0208409 | A1 | 7/2020 | Kell |
| 2020/0248462 | A1 | 8/2020 | Bergelin et al. |
| 2020/0362567 | A1 | 11/2020 | Nilsson et al. |
| 2020/0407981 | A1 | 12/2020 | Boo et al. |
| 2021/0115680 | A1 | 4/2021 | Whispell et al. |
| 2021/0207385 | A1 | 7/2021 | Boo |
| 2021/0230881 | A1 | 7/2021 | Boo |

FOREIGN PATENT DOCUMENTS

| | | | |
|---|---|---|---|
| DE | 20 2005 004 537 | U1 | 6/2005 |
| DE | 198 54 475 | B4 | 6/2006 |
| DE | 10 2005 061 099 | A1 | 3/2007 |
| DE | 10 2006 024 184 | A1 | 11/2007 |
| DE | 20 2008 011 589 | U1 | 11/2008 |
| DE | 20 2008 012 001 | U1 | 11/2008 |
| DE | 20 2004 021 867 | U1 | 12/2011 |
| DE | 20 2016 102 034 | U1 | 5/2016 |
| EP | 1 045 083 | A1 | 10/2000 |
| EP | 1 045 083 | B1 | 10/2002 |
| EP | 1 308 577 | A2 | 5/2003 |
| EP | 1 350 904 | A2 | 10/2003 |
| EP | 1 350 904 | A3 | 10/2003 |
| EP | 1 420 125 | A2 | 5/2004 |
| EP | 1 585 875 | | 10/2005 |
| EP | 1 585 875 | B1 | 10/2006 |
| EP | 1 570 143 | | 5/2007 |
| EP | 2 339 092 | A1 | 6/2011 |
| EP | 2 615 221 | A1 | 7/2013 |
| FR | 1 293 043 | | 4/1962 |
| GB | 1 430 423 | A | 3/1976 |
| JP | S60-255843 | A | 12/1985 |
| JP | H07-180333 | A | 7/1995 |
| JP | H07-300979 | | 11/1995 |
| JP | H08-74405 | A | 3/1996 |
| KR | 1996-0005785 | | 7/1996 |
| KR | 10-2008-0096189 | | 10/2008 |
| KR | 10-0870496 | | 11/2008 |
| WO | WO 94/26999 | A1 | 11/1994 |
| WO | WO 00/66856 | A1 | 11/2000 |
| WO | WO 01/44669 | A2 | 6/2001 |
| WO | WO 01/44669 | A3 | 6/2001 |
| WO | WO 01/48332 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/88306 | A1 | 11/2001 |
| WO | WO 03/012224 | A1 | 2/2003 |
| WO | WO 2004/011740 | A2 | 2/2004 |
| WO | WO 2004/016877 | A1 | 2/2004 |
| WO | WO 2005/068747 | A1 | 7/2005 |
| WO | WO 2005/088029 | A1 | 9/2005 |
| WO | WO 2005/098163 | A1 | 10/2005 |
| WO | WO 2006/032378 | A1 | 3/2006 |
| WO | WO 2006/043893 | A1 | 4/2006 |
| WO | WO 2006/104436 | A1 | 10/2006 |
| WO | WO 2006/123988 | A1 | 11/2006 |
| WO | WO 2006/133690 | A1 | 12/2006 |
| WO | WO 2007/015669 | A2 | 2/2007 |
| WO | WO 2007/015669 | A3 | 2/2007 |
| WO | WO 2007/016978 | | 2/2007 |
| WO | WO 2007/020088 | A1 | 2/2007 |
| WO | WO 2007/079845 | A1 | 7/2007 |
| WO | WO 2007/118352 | | 10/2007 |
| WO | WO 2008/008016 | A1 | 1/2008 |
| WO | WO 2008/008824 | A1 | 1/2008 |
| WO | WO 2008/068245 | A1 | 6/2008 |
| WO | WO 2008/116623 | A1 | 10/2008 |
| WO | WO 2008/133377 | A1 | 11/2008 |
| WO | WO 2009/061279 | A1 | 5/2009 |
| WO | WO 2009/071822 | A2 | 6/2009 |
| WO | WO 2009/071822 | A3 | 6/2009 |
| WO | WO 2010/015516 | A2 | 2/2010 |
| WO | WO 2010/015516 | A3 | 2/2010 |
| WO | WO 2010/072357 | A2 | 7/2010 |
| WO | WO 2010/072357 | A3 | 7/2010 |
| WO | WO 2010/081532 | A1 | 7/2010 |
| WO | WO 2010/086084 | A1 | 8/2010 |
| WO | WO 2010/114236 | A2 | 10/2010 |
| WO | WO 2010/128043 | A1 | 11/2010 |
| WO | WO 2011/012104 | A2 | 2/2011 |
| WO | WO 2011/012104 | A3 | 2/2011 |
| WO | WO 2011/028171 | A1 | 3/2011 |
| WO | WO 2011/038709 | A1 | 4/2011 |
| WO | WO 2012/084604 | A1 | 6/2012 |
| WO | WO 2012/101171 | A1 | 8/2012 |
| WO | WO 2012/126046 | A1 | 9/2012 |
| WO | WO 2012/136021 | A1 | 10/2012 |
| WO | WO 2013/017575 | A1 | 2/2013 |
| WO | WO 2013/026559 | A2 | 2/2013 |
| WO | WO 2013/044758 | A1 | 4/2013 |
| WO | WO 2013/151493 | A1 | 10/2013 |
| WO | WO 2014/007738 | A1 | 1/2014 |
| WO | WO 2014/043756 | A1 | 3/2014 |
| WO | WO 2014/182215 | A1 | 11/2014 |
| WO | WO 2014/209213 | A1 | 12/2014 |
| WO | WO 2015/104680 | A1 | 7/2015 |
| WO | WO 2015/174914 | A1 | 11/2015 |
| WO | WO 2016/029255 | A1 | 3/2016 |
| WO | WO 2017/101910 | A1 | 6/2017 |
| WO | WO 2017/115202 | A1 | 7/2017 |
| WO | WO 2017/187298 | A2 | 11/2017 |

OTHER PUBLICATIONS

U.S. Appl. No. 16/887,559, John M Whispell and Hao A Chen, filed May 29, 2020, (Cited herein as US Patent Application Publication No. 2021/0115680 A1 of Apr. 22, 2021).

(56) References Cited

OTHER PUBLICATIONS

U.S. Appl. No. 17/017,085, Christian Boo, Marcus Nilsson Ståhl and Anders Nilsson, filed Sep. 10, 2020, (Cited herein as US Patent Application Publication No. 2020/0407981 A1 of Dec. 31, 2020).
U.S. Appl. No. 17/067,989, Christian Boo, filed Oct. 12, 2020, (Cited herein as US Patent Application Publication No. 2021/0230881 A1 of Jul. 29, 2021).
U.S. Appl. No. 17/076,445, Christian Boo, filed Oct. 21, 2020, (Cited herein as US Patent Application Publication No. 2021/0207385 A1 of Jul. 8, 2021).
International Search Report and Written Opinion, dated Nov. 10, 2015 in PCT/AU2015/000531, ISA/AU, Australian Patent Office, Woden Act 2606, AU, 12 pages.
Extended European Search Report issued in EP 15835947.1, dated Jan. 16, 2018, Munich, DE, 10 pages.
Extended European Search Report issued in EP 19182019.0, dated Aug. 28, 2019, EPO, Munich, DE, 8 pages.
Pervan, Darko (Author)/Valinge Innovation, Technical Disclosure entitled "VA073a Zip Loc," Sep. 13, 2011, IP.com No. IPCOM000210869D, IP.com PriorArtDatabase, 36 pages.
Communication Pursuant to Article 94(3) EPC dated Oct. 13, 2017 in EP Patent Application No. 14 794 996.0, EPO, Munich, DE, 9 pages.
U.S. Appl. No. 17/694,843, Mats Nilsson and Per Nygren, filed Mar. 15, 2022.
Nilsson et al., U.S. Appl. No. 17/694,843 entitled "Resilient Floor", filed Mar. 15, 2022.

VERTICAL JOINT SYSTEM FOR A SURFACE COVERING PANEL

CROSS REFERENCE TO RELATED APPLICATIONS

The present application is a continuation of U.S. application Ser. No. 16/699,297, filed on Nov. 29, 2019, which is a continuation of U.S. application Ser. No. 16/392,931, filed on Apr. 24, 2019, which is a continuation of U.S. application Ser. No. 15/507,602, filed on Feb. 28, 2017, now U.S. Pat. No. 10,316,526, which is a U.S. national stage of International Application No. PCT/AU2015/000531, filed on Aug. 31, 2015, which claims the benefit of Australian Application No. 2014903452, filed on Aug. 29, 2014. The entire contents of each of U.S. application Ser. No. 16/699,297, U.S. application Ser. No. 16/392,931, U.S. application Ser. No. 15/507,602, International Application No. PCT/AU2015/000531, and Australian Application No. 2014903452 are hereby incorporated herein by reference in their entirety.

TECHNICAL FIELD

The present disclosure relates to a vertical joint system for a surface covering panel such as but not limited to a floor panel, wall panel or ceiling panel.

BACKGROUND ART

One form of vertical joint system for a surface covering panel may include male and female parts. The male and female parts are formed along the sides of the panel. The male and female parts engage each other to join corresponding panels when moved toward each other in a direction perpendicular to a plane of the panels. When the panels are flooring panels this direction is a vertical direction. The male and female parts have surfaces that contact each other to arrest vertical separation of engaged panels.

One potential problem with vertical joint systems is "lipping". Lipping occurs when the upper edge of one panel lifts from the upper edge of the adjoining panel. This creates a lip or step at the upper edges of adjacent joined panels. To assist in reducing lipping one practice is to provide the contacting surfaces of the male and female parts at the front end of the joints. The front end of the joint is the end closest to an upper edge of an upper surface of the panels. An example of this is shown in U.S. Pat. No. 7,552,568 in which the front end of a male part has a surface formed with a locking heal that contacts a locking surface formed on the surface at the front end of a female part. An alternate practice is to uses separately manufactured plastic inserts or clips that are fitted into the panels. However this adds to manufacturing costs and the insert/clips at times fall out of the panels during transport and handling.

The above description of the background art does not constitute an admission that the art forms the common general knowledge of a person of ordinary skill in the art. Further, the above description is not intended to limit the application of the vertical joint system.

SUMMARY OF THE DISCLOSURE

In one aspect there is disclosed a vertical joint system for a surface covering panel having an upper surface which is visible when the surface covering is laid and an opposed lower surface and a plurality of sides located between the upper and lower surfaces, the vertical joint system comprising:

a male part along a first of the sides;

a female part along a second of the sides, the second side being opposite to the first side;

the female part having a protrusion that extends from the lower surface toward the upper surface and an outer most female surface on the protrusion, the male part having a recess that opens onto the lower surface, a portion of the recess forming an inner most male surface; and wherein the outer most female surface and the inner most male surface arranged so that when the male part of one surface covering panel is engaged with a female part of a second surface covering panel the outer most female surface overlies the inner most male locking surface at a first location and a second location.

In one embodiment in at least one of the first and second locations the outer most female surface and the inner most male surface contact each other when the lower surfaces of two joined like panel lie in a common plane.

In one embodiment the outer most female surface and the inner most male surface contact each other at the first location and wherein the first location is closer to the lower surface than the second location.

In one embodiment the second location overhangs the first location.

In one embodiment the inner most male surface at the first location has a first surface portion with a first tangent plane at a first region of contact with the outer most female surface that is inclined at an angle $\theta_m°$ in the range of about 15° to 75° to a plane parallel to the upper surface.

In one embodiment the angle $\theta_m°$ is about 45° to a plane perpendicular to the upper surface.

In one embodiment the first surface portion is one of: a surface portion of a generally convex protuberance; and a planar surface portion.

In one embodiment the outer female surface adjacent the first region of contact and on a side nearest the bottom surface is generally inclined at an angle $\theta_f° \leq \theta_m°$.

In one embodiment the angle $\theta_f°$ is about 15° to the plane parallel to the upper surface.

In one embodiment inner most male surface at the second location has a second surface portion with a second tangent plane at a second region of contact with the outer most female surface that is inclined at an angle $\beta_m°$ in the range of about 15° to 75° to a plane parallel to the upper surface.

In one embodiment the second tangent plane is inclined at an angle $\beta_m°$ of about 45° to a plane parallel to the upper surface.

In one embodiment at the second location the outer most female surface at the second region of contact with the inner most male surface has a surface portion lying in the second tangent plane.

In one embodiment the male part has a male protrusion adjacent to the male recess with an outer most male surface formed on the male protrusion distant the male recess; the female part has a female recess adjacent the female protrusion, wherein the female recess has an inner most female surface distant the female protrusion; and wherein inner most female surface overlies the outer most male surface.

In one embodiment the inner most female surface is provided with a series of contiguous recesses and the outer most male surface is provided with a nib; the inner most female surface and the outer most male surface configured so that when the male part is fully engaged with the female part the nib resides in a lowest one of the contiguous recesses; and in response to a relative rotation or uplift of the male part relative to the female part the nib can enter respective higher recesses sequentially to provide resistance to the withdrawal of the male protrusion from the female recess.

In one embodiment the female part has a datum surface on which the male part bears when the male and female parts of respective vertical joint systems, the datum surface providing a depth control for the male part when inserted into the female part.

In one embodiment the continuous gap extends between the male part and the female part from the datum surface to the second location.

In one embodiment the continuous gap extends between the male part and the female part from the datum surface to the first location.

In one embodiment the female part has a datum surface on which the male part bears when the male and female parts of respective vertical joint systems, the datum surface providing a depth control for the male part when inserted into the female part; and wherein the male and female parts are configured to contact each other when engaged at the one or both of the first and second locations in a manner to press the datum surfaces together.

In one embodiment the vertical joint system comprises a continuous gap from a location where the datum surfaces contact each other to a nearest one of the first location and the second location at which the male and female part contact each other.

In one embodiment the male part has a common male surface that lies on both the male protrusion and the male recess, the female part has a common female surface that lies on both the female protrusion and the female recess and wherein the vertical joint is configured so that when the male and female parts of respective vertical joint systems are coupled together with the respective lower surfaces in a common plane, a continuous gap is provided between the inner most female surface and the outer most male surface from the datum surfaces to at least the common male surface.

In a second aspect there is disclosed a vertical joint system for a surface covering panel having an upper surface which is visible when the surface covering is laid and an opposed lower surface and a plurality of sides located between the upper and lower surfaces, the vertical joint system comprising:

vertically engageable locking parts on at least two opposed sides, the locking parts having proximal mutually receivable components near an edge of the upper surface of a panel in which the vertical joint system is provided, and distal mutually receivable components near an edge of the lower surface of the panel, and wherein the distal components are configured so that when the respective locking parts of two panels with the same vertical locking system are engaged, a surface on a side of one of the distal components nearest the lower surface overlies a surface on a side of the other distal component nearest the lower surface at a first location and a second location.

In one embodiment the proximal components have respective datum surfaces which contact each other providing a depth control mechanism for the vertical joint system when two panels with the same vertical joint system are engaged so that the upper surfaces of the two panels are substantially coplanar.

In one embodiment the distal parts of two like joint systems are configured to contact each other when engaged at the one or both of the first and second locations in a manner to press the datum surfaces together.

In one embodiment the surface on the side of the other distal component at the first location has a first surface portion with a first tangent plane that is inclined at an angle $\theta_m°$ in the range of about 15° to 75° to a plane parallel to the upper surface.

In one embodiment the angle $\theta_m°$ is about 45° to the plane parallel to the upper surface.

In one embodiment the vertical joint system comprises a continuous gap from a location where the datum surfaces contact each other to one of: the first location; the second location; and the lower surface.

In a third aspect there is provided vertical joint system for a surface covering panel having an upper surface which is visible when the surface covering is laid and an opposed under surface and a plurality of sides located between the upper and under surfaces, the vertical joint system comprising:

a male part along a first of the sides;

a female part along a second of the sides, the second side being opposite to the first side;

the male and female parts being configured so that when the male part of one surface covering panel is engaged with a female part of a second surface covering panel to create an engaged joint having a proximal end near respective upper edges of upper surfaces of the panels and a distal end near respective lower edges of lower surfaces of the panels:

(a) at the proximal end of the engaged joint the male part rests on the female part in a datum plane controlling a depth of insertion of the male part in the female part so that the upper surfaces of the panels are co-planar;

(b) at the distal end of the engaged joint the male part at contacts on overlying portion of the female part to hold or press the male and female parts together at the datum plane.

In one embodiment the male and female parts are configured so that in the engaged joint a continuous gap is formed between the male and female part from the datum plane to where the male part at contacts on overlying portion of the female part.

In one embodiment the male and female parts are configured so that in the engaged joint a first continuous gap is formed between the male and female part from the datum plane to an intermediate location and a second continuous gap is formed from the intermediate location to the where the male part at contacts on overlying portion of the female part.

In one embodiment at the distal end the male part contacts an overlying portion of the female part at two locations which are spaced from each other.

In a fourth aspect there is disclosed a vertical joint system for a surface covering panel having an upper surface which is visible when the surface covering is laid and an opposed under surface and a plurality of sides located between the upper and under surfaces, the vertical joint system comprising:

a male part along a first of the sides;

a female part along a second of the sides, the second side being opposite to the first side;

the male and female parts being configured so that when the male part of one surface covering panel is engaged with a female part of a second surface covering panel to create an engaged joint having a proximal end near respective upper edges of upper surfaces of the panels and a distal end near respective lower edges of lower surfaces of the panels:

(a) at the proximal end of the engaged joint the male part rests on the female part in a datum plane controlling a depth of insertion of the male part in the female part so that the upper surfaces of the panels are co-planar;

(b) at the distal end of the engaged joint the female part overlies the male part in at least one location; and (c) a continuous gap is formed between the male and female part from the datum plane to one of: a nearest one of the at least one location; and, the lower surface of the panels.

In one embodiment the male part has a first surface portion with a first tangent plane at a first region of contact with a surface portion of the female surface at the distal end of the engaged joint that is inclined at an angle $\theta_m°$ in the range of about 15° to 75° to a plane parallel to the upper surface.

In one embodiment of each of the above aspects the vertical joint system comprises a laterally extending tongue and a groove, one of each on respective other opposed sides of the panel, the laterally extending tongue and the groove arranged to cooperate with each other to provide a laydown joint between two like panels when mutually engaged along the other opposed sides.

In a fifth aspect there is disclosed a vertical joint system for a surface covering panel having first and second opposed major surfaces and a plurality of sides located between the major surfaces, the vertical joint system comprising:

a male part along a first of the sides;

a female part along a second of the sides, the second side being opposite to the first side;

the male and female parts being relatively configured so that during engagement of like first and second panels each provided with the vertical joint system by bringing the male part of a first panel toward the female part of the second panel in a direction perpendicular to a plane the male part while maintaining contact with the female part also moves laterally toward, then away from and subsequently toward the second panel.

In one embodiment the male part has a protrusion and an adjacent recess with a common surface forming a part of both the recess and the protrusion, the common surface being formed with a concavity.

In one embodiment the common surface includes a first portion that lies in a plane substantially perpendicular to a plane of a panel, the first portion being contiguous with the concavity.

In one embodiment the female part is formed with a female recess and an adjacent female protrusion, wherein the female recess has an inner most female surface and the male protrusion has an inner most male surface, the inner most male surface being on a side opposite the common surface; when the inner most female surface overlies the inner most male surface.

In one embodiment the inner most female surface is provided with a series of contiguous recesses and the male surface is provided with a nib; the inner most female surface and the inner most male surface configured so that when fully engaged the nib resides in a lowest one of the recesses; and in response to a relative rotation of the male part and female part the nib can enter respective higher recesses sequentially to provide resistance to the withdrawal of the male protrusion from the female recess.

In one embodiment the female protrusion and the male recess are relatively configured so that the female protrusion overlies the male recess in at least two locations which are spaced apart by a gap.

In a sixth aspect there is disclosed a vertical joint system for a surface covering panel having first and second opposed major surfaces and a plurality of sides located between the first and lower surfaces, the vertical joint system comprising:

a male part along a first of the sides, the male part having an inner most male surface, an outer most male surface, and an intermediate common surface;

a female part along a second of the sides, the second side being opposite to the first side, the female part having an inner most female surface, an outer most female surface, an intermediate common female surface;

the inner most female surface being provided with a series of contiguous recesses and the inner most male surface being provided with a nib wherein; the inner most female surface and the inner most male surface are configured so that when fully engaged the nib resides in a lowest one of the recesses; and in response to a relative rotation of the male part and female part the nib can enter respective higher recesses sequentially to provide resistance to the withdrawal of the male protrusion from the female recess.

In one embodiment the outer most female surface and the outer most male surface are relatively configured so that the outer most female surface overlies the outer most male surface in at least two locations which are spaced apart by a gap when the male part is engaged in the female part.

DETAILED DESCRIPTION OF THE DRAWINGS

Notwithstanding any other forms that may fall within the scope of the vertical joint system as set forth in the Summary, specific embodiments will now be described by way of example only with reference to the accompanying drawings in which:

FIG. 1*a* is a section view of a single panel showing male and female parts of a first embodiment of the disclosed vertical joint system on opposite sides of the panel;

FIG. 1*b* is a schematic representation of two mutually engaged surface covering panels each provided with the first embodiment of the disclosed vertical joint system;

Figure 7A:
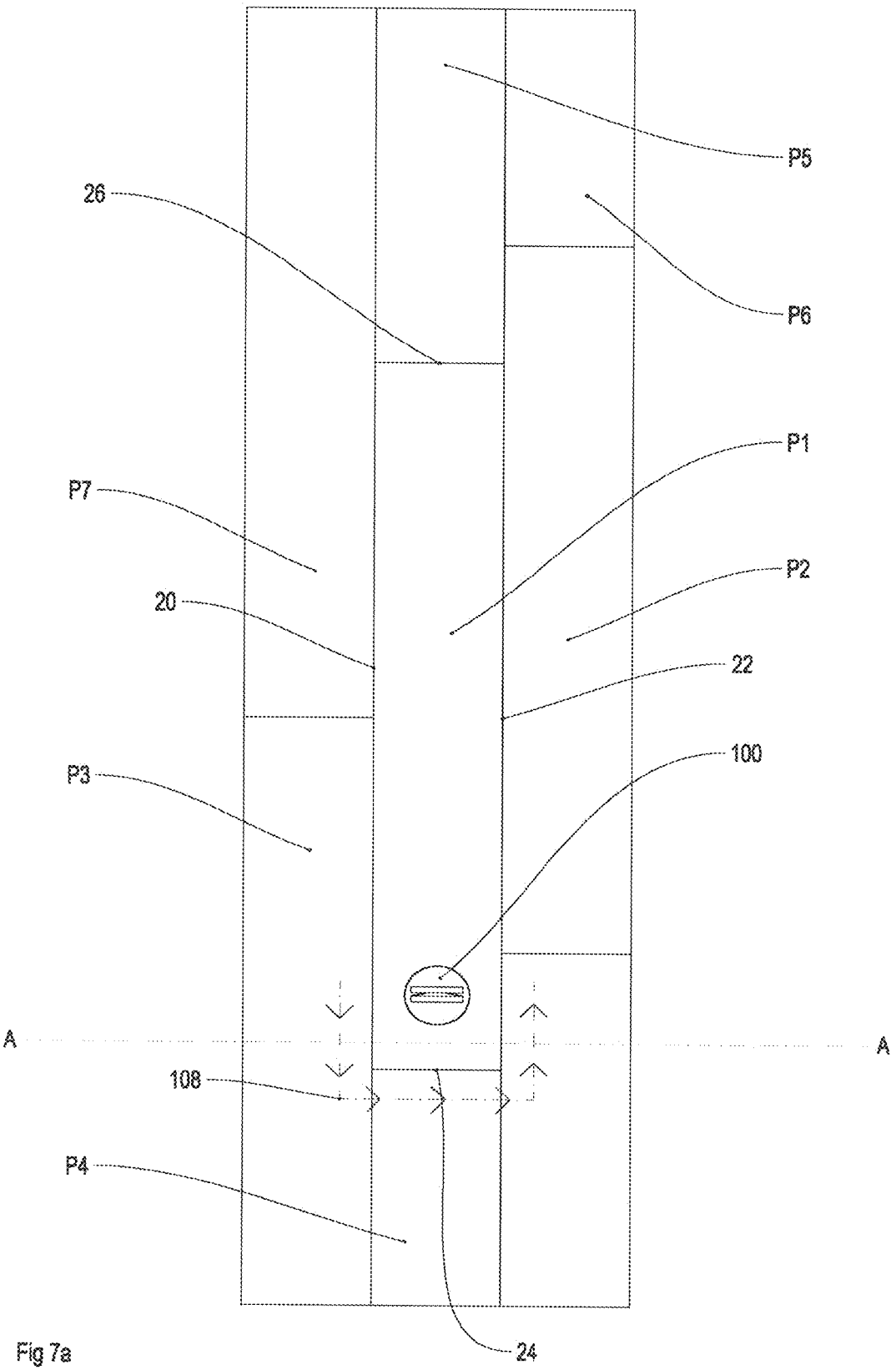

FIG. 7*a* depicts a surface covering made from engaged panels provide with embodiments of the disclosed vertical joint system; and FIGS. 7*b*-7*k* illustrate a sequence of steps for replacing the damage panel of the surface covering shown in FIG. 7*a* viewed along section AA.

DETAILED DESCRIPTION OF SPECIFIC EMBODIMENTS

Figure 1A:
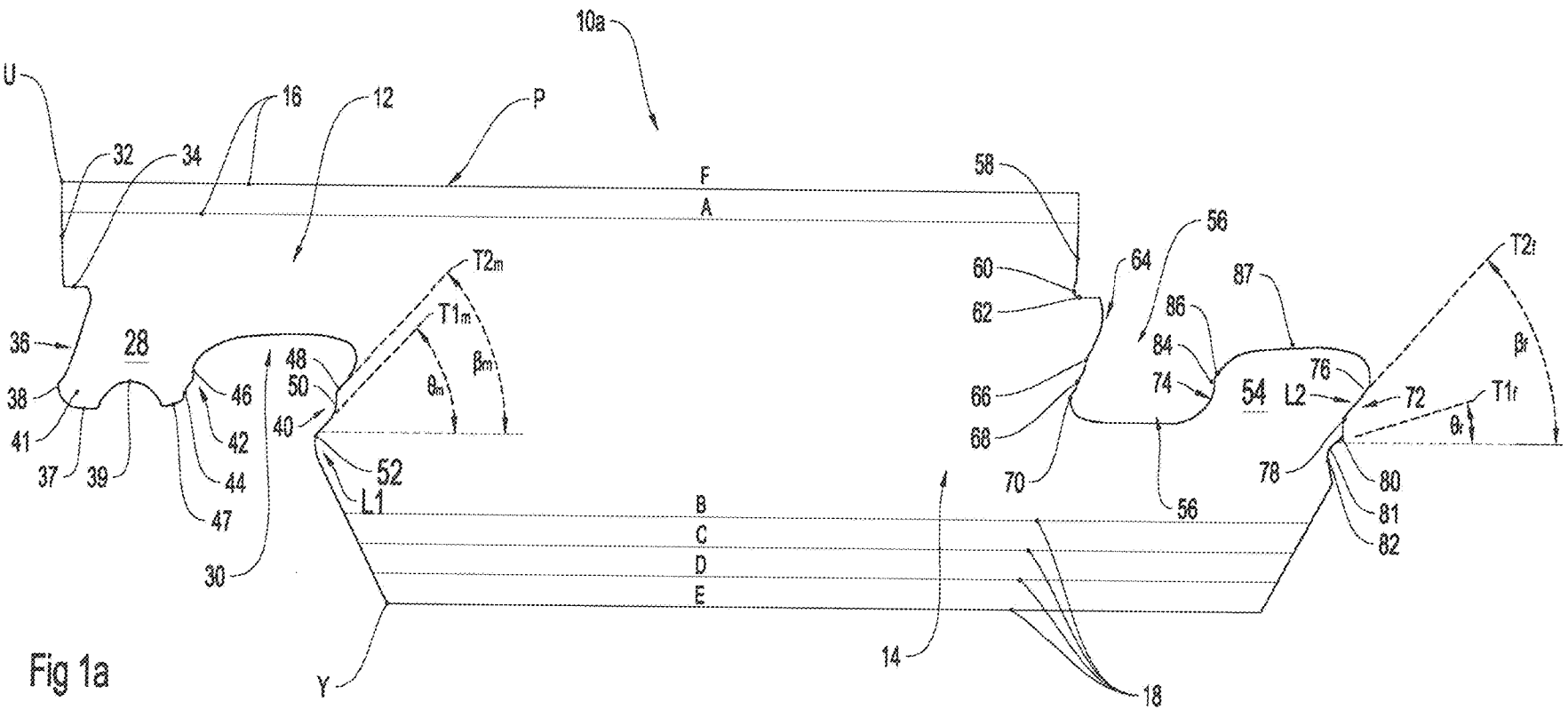
Figure 1B:
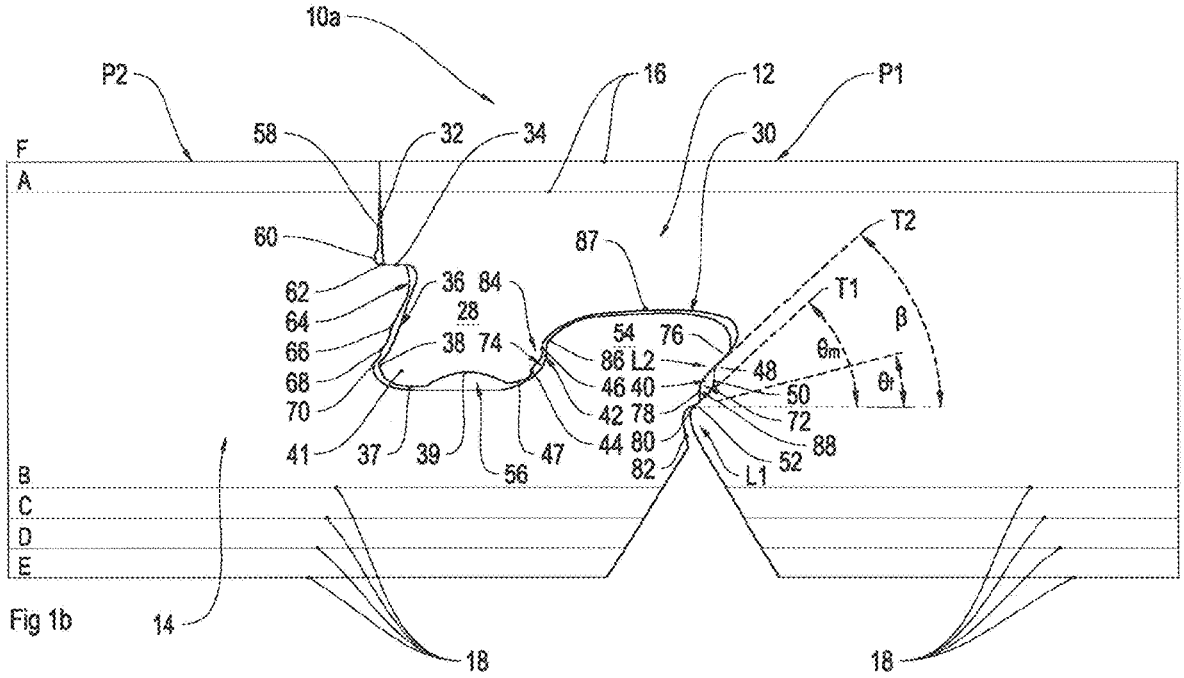
Figure 2:
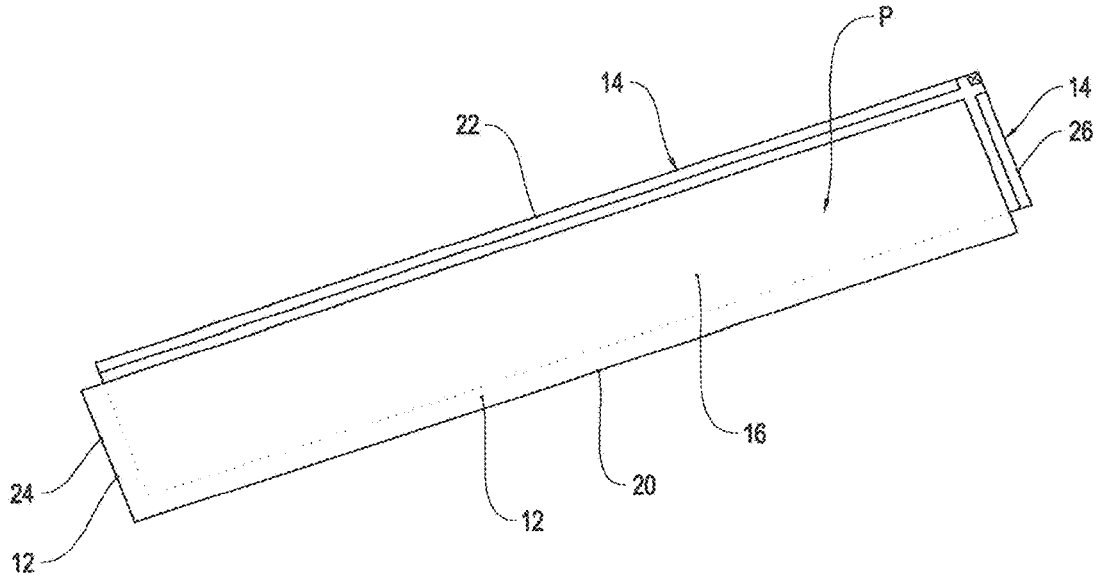
FIG. 2 is a schematic representation of a surface covering panel provided with the vertical joint system as depicted in FIGS. 1*a* and 1*b;*

FIG. 1*a*-1*b* and 2 depict a first embodiment of the disclosed vertical joint system 10*a*. FIG. 1*a* shows the joint system 10*a* as a male part 12 and a female part 14 on opposite sides of a panel P. FIG. 1*b* shows the male joint 12 on one panel P1 engaged with the female joint of panel P2 where the panels P1 and P2 are identical to panel P. For ease of description the panels P, P1 and P2 will be hereinafter referred to in general as "panels P". Each panel P has an upper surface 16 and an opposite lower surface 18. The upper surface 16 may be considered as a top or wear surface of the panel P. The lower surface 18 may be considered as the undersurface which would ordinarily face a substrate or other support on which the panels P are laid or otherwise attached.

FIG. 2 depicts a rectangular form of the panel P. Here the panel P is formed with opposite longitudinal sides 20 and 22 and opposite transverse sides 24 and 26. Each of the size 20, 22, 24 and 26 is located between the first and lower surfaces 16 and 18. In one embodiment the male part 12 may be formed along a first longitudinal side 20 and the female part 14 may be formed along the opposite longitudinal side 22. Additionally, a male part 12 can be formed along the transverse side 24 and a female part 14 can be formed along the opposite transverse side 26. However as exemplified later the panel P can be formed with a male and female joint on only one side each.

The male part 12 has a protrusion 28 and an adjacent recess 30. The protrusion 28 extends in a direction from the upper surface 16 toward the lower surface 18. The recess 30 is formed or extends from the lower surface 18 toward the upper surface 16.

Starting from the upper surface 16 the male part 12 has an upper edge U from which extends a generally vertical surface 32. This is followed by a generally datum surface 34 and then an outer most (or proximal) male surface 36. In this embodiment the datum surface 34 is a planar and horizontal surface. The outer most male surface 36 is generally inclined away from the recess 30 in a direction from the upper surface 16 toward the lower surface 18. However the outer most/proximal surface 30 does not extend laterally beyond an upper edge U. A lower part of the outer most male surface 36 is formed with a nib 38. The outer most male surface 36 is at a front or proximal end of the joint system 10*a* as is lies on a surface nearest the upper edge U of the panel Pin which the joint system is made.

A bottom surface 37 of the male protrusion is formed with a central concave recess 39 that projects toward the upper surface 16. The recess provides a space for foreign material such as: wax or other lubricant which may be placed on surfaces of the joint system 10*a*; debris produced during manufacture which has not been fully removed; and debris that exists or is generated on site during installation. A portion of the male protrusion 28 to the left of the recess 39 which includes the outer most male surface 36 and nib 38 may be considered as forming a nose 41 of the protrusion 28. The portions 37 and 47 provide the bottom end of the protrusion 28 with curved or rounded corners.

The male part 12 is also formed with an inner most (or distal) male surface 40. The inner most/distal male surface 40 is at a back or distal end of the joint system 10*a* as it lies on a surface distant the upper edge U of the panel P in which the joint system 10*a* is made (or conversely closest to a bottom edge B of the panel P). The inner most male surface 40 is formed as a surface of the recess 30. Located between the outer most male surface 36 and the inner most male surface 40 is a male common surface 42. The male common surface 42 is a surface which is common to both the protrusion 28 and the recess 30.

The male common surface 42 is formed with a concavity 44. This is followed by a contiguous male planar portion 46. The male planar portion 46 lies in a plane perpendicular to that of the surfaces 16 and 18. Additionally the male planar portion 46 is located between the upper surface 16 and the concavity 44. A convexly curved surface 47 extends between the concavity 44 and the recess 39.

The outer most male surface 40 is formed with an undulating profile which forms a first generally convex protuberance 48, a contiguous concave recess 50 and a contiguous second generally convex protuberance 52. After the protuberance 52 the outer most male surface 40 extends to the major surface 18.

The female part 14 is formed with a female protrusion 54 and a female recess 56 which is inboard of the protrusion 54. When the male and female parts of like panels P1 and P2 are fully engaged the male protrusion 28 is located in the female recess 56 and the female protrusion 54 is located in the male recess 30.

The female recess 56 has a surface 58 that depends generally perpendicular from an upper edge U of the upper surface 16 on a side opposite to that of the male part 12. Contiguous with the surface 58 is a concavity 60. The concavity 60 subsequently leads to a datum surface 62 in the recess 56. The datum surface 62 lies parallel to the upper surface 16 and together with the datum surface 34 constitutes a datum plane for the joint system 10*a*. Thus in an engaged joint system 10 both the datum surfaces 34 and 62 lie in the datum plane. The datum surface acts as a depth control for the insertion of the male part of panel P1 into the female part of panel P2. When the datum surface 34 abuts the datum surface 62 insertion of the male part 12 and in particular the protrusion 28 into the female part 14/recess 56 is halted. This ensures that the upper surfaces 16 of adjacent coupled panels P1, P2 are essentially coplanar.

After the datum 62 the female part 14 is provided with an inner most female surface 64 that extends to a root of the recess 56. The inner most (or proximal) female surface is at a front or proximal end of the joint system 10*a* as it lies on a surface near an upper edge U of the panel P in which the joint system is made. The inner most female surface 64 is formed with a plurality of recesses 66, 68 and 70. The recess 70 is closest to the root of the recess 56.

The female joint 14 is also formed with an outer most (or distal) female surface 72 on a side of the female protrusion 54 distant the recess 56. The outer most female surface is at a back or distal end of the joint system 10*a* as it lies on a surface distant the upper edge U of the panel P in which the joint system is made (or conversely closest to a bottom edge Y of the panel P). A female common surface 74 forms part of the surface of both the female recess 56 and the female protrusion 54.

The outer most female surface 72 is formed with a generally undulating profile and includes a first protuberance 76 followed by a concavity 78 followed by a contiguous second protuberance 80. Contiguous with the second protuberance 80 is a further concavity 82. The concavity 82 then leads to the lower surface 18 and edge Y on the female side.

The female common surface 74 includes a female generally planar portion 84 followed by a contiguous convex portion 86. The female planar portion 84 is located between the convex portion 86 and the lower surface 18. The female protrusion 54 has a very slightly curved, indeed almost planar, top surface 87 that is substantially parallel with the upper and lower surfaces 16, 18. The portions 86 and 76 provide curved or rounded corners to the upper end of the protrusion 54.

The inner most (i.e. distal) male surface 40 and the outer most (i.e. distal) female surface 72 can be considered to be a clasping surfaces because when male and female parts 12, 14 of the joint system 10*a* are engaged these surfaces are able to clasp each other to arrest vertical separation of engaged panels P.

In this embodiment the there is a minimum of about 30% of the thickness of the material of the panel P from the bottom of the recess 56 to the lower surface 18. The location L1 is at a horizontal level marginally below the bottom of the recess 56 and the second location L2 is horizontal level above the bottom of the recess 56.

When the male joint 14 of one panel P1 is fully engaged with the female joint 16 of a second panel P2 with the respective lower surfaces 18 coplanar, the following relationships between respective surfaces in parts of the joints exist:

(a) The surfaces 32 and 58 abut or are closely adjacent so as to form no gap or at least no easily discernable gap between joint panels P1 and P2 when viewed from a normal standing position.

(b) The datum surface 34 abuts the datum surface 62. This forms a depth control mechanism so that the major surfaces 16 of the join panels P1 and P2 are substantially co-planar. Moreover the back end of the joint constituted by the male and female surfaces 40 and 72 when in contact at location L1 generate tension or force in the protrusion 28 pulling the datum 34 onto the datum surface 62, or otherwise pushing or pressing the datum surfaces 43, 62 together. In this way the contacting datum surfaces 34, 62 and the contacting surfaces at L1 act to claps the joint together.

(c) The nib 38 resides in the lower most recess 70. These provide a back-up or secondary vertical arrestment or grab resisting removal of the protrusion 28 from the recess 56. However due to the existence of a gap between the proximal male surface 36 and proximal female surface 64 these surfaces do not provide a vertical locking function when the panels P are in a neutral plane, i.e. when the surfaces 18 of the joined panels P1 and P2 are co-planar.

(d) The male and female planar surfaces 46 and 84 face each other. The surfaces 46 and 84 may be in contact with each other or slightly spaced from each other. This can be dependent on environmental conditions such as temperature, manufacturing tolerances, and the condition of the underlying surface on which the panels are laid. However vertical joint 10*a* can be designed to ensure the existence of a gap in all expected environmental conditions or to ensure contact of the surfaces 46 and 84 in all expected environmental conditions. The gap when provided between the surfaces 46 and 84 can assist in allowing relative sliding between panels which can assist in the engagement of panels P together. Also the existence of such a gap can allow for the take up of wax or other lubricant.

(e) The outer most female surface 72 overlies the inner most male surface 40 in at least a first location L1 and a second location L2. The first location L1 is a lower of the locations, being closer to the lower surface 16, and coincides with the location of protuberance 80. The second of the locations L2 is a higher of the locations and coincides with the location of the protuberance 76. Thus in general terms the protuberance 76 overlies the protuberance 48 while the protuberance 80 overlies the protuberance 52. The two locations L1 and L2 are spaced by a gap 88. The gap 88 is formed between the concavities 50 and 78. Also the second location L2 overhangs the first location L1. The gap 88 and moreover the concavities/recess 50 and 78 provided relief during the engagement of the male and female parts enabling the parts to fit together without the need for heavy blows with a mallet and/or substantial deflection or distortion of the material in the joint. Such deflection or distortion can damage or break parts of the joint. Also when the panel is made of a plastics material, the material may maintain a degree of the deflection after engagement due to material memory. This results in lipping at the very time of, and due to, installation.

In the present embodiment the outer most (distal) female surface 72 contacts the inner most male surface 40 at least at the first location L1. This forms the primary vertical lock or arrestment for the joint system. The expression "vertical lock or arrestment" means locking or arresting vertical separation between the engaged panels. Also in this embodiment the surfaces 40 and 72 also contact each other at the second location L2 simultaneously with contact at location L1 so as to also form part of the primary vertical lock or arrestment. But in other embodiments this need not be the case. For example the protuberances 76 and 48 may be spaced apart when joined panels P are in the neutral plane but arranged to contact each other when the panels are either (i) under compression in a direction tending to push the surfaces 40 and 72 together, or (ii) relatively rotated as would occur during removal of say panel P1 from panel P2 where panel P1 may be gripped (for example by a suction cup) and pulled upwardly and away from panel P2.

At the first location L1 the inner most (i.e. distal) male surface has a first surface portion with a first tangent plane Tim that is inclined at an angle $\theta_m$ in the range of about 15° to 75° to a plane parallel to the upper surface. The first surface portion is constituted by a surface portion of the generally convex protuberance 52. This surface portion could be either curved or planar. When it is planar (as shown in the embodiment of FIGS. 1*a* and 1*b*) then the plane of the surface portion is also parallel with the tangent plane T1. The angle $\theta_m$ may be any angle within the above range for example 15°, or 45° or 75°. Also the angle $\theta_m$ may be constituted by any sub range within the range of about 15° to 75°, for example 30° to 60°. In this embodiment the angle $\theta_m$ is 45°.

At the first location L1 the outer most (distal) female surface 72 also has a first surface portion 81 with a first tangent plane T1*f* that is inclined at the angle $\theta_f$. The first surface portion 81 of the outer most female surface is constituted by a surface portion of the generally convex protuberance 80. This surface portion could be either curved or planar. In any event $\theta_f° \leq \theta_m°$, and preferably $\theta_f° < \theta_m°$. In one example $\theta_m = 45°$ and $\theta_f = 15°$.

At the second location L2 the inner most male surface has a first surface portion with a first tangent plane T2*m* that is inclined at an angle $\beta_m$ in the range of about 15° to 75° to a plane perpendicular to the upper surface. The first surface portion is constituted by a surface portion of the generally convex protuberance 48. This surface portion could be either curved or planar. When it is planar (as shown in the embodiment of FIGS. 1*a* and 1*b*) then the plane of the surface portion is also parallel with the tangent plane T2*m*. The angle $\beta_m$ may be any angle within the range for example 15°, or 45° or 75°. Also the angle $\beta_m$ may be constituted by any sub range within the range of about 15° to 75°, for example 30° to 60°.

At the second location L2 the outer most female surface also has a first surface portion with a first tangent plane T2*f* that is inclined at the angle $\beta_f$. The first surface portion of the outer most female surface is constituted by a surface portion of the generally convex protuberance 76. This surface portion could be either curved or planar. When it is planar (as shown in the embodiment of FIGS. 1*a* and 1*b*) then the plane of the surface portion is also or at least is parallel with the tangent plane T2*f*. In the present embodiment $\beta_f=\beta_m$, but more generally $\beta_f \leq \beta_m$ The distal male and female surfaces 40 and 72 in effect provide a primary dual or two stage vertical lock at the back end of the joint when in contact with each other at both locations L1 and L2.

(f) In this embodiment there is a continuous gap between the male and female parts 12, 14 from the location where the datum surface 34 contacts the datum 62 to the location L2 where the protuberances 48 and 76 contact each other. However as will be exemplified in later, in other embodiments there may be contact between the planar surfaces 46 and 84 so as to divide the previously mention gap into two parts; one part from the contacting datum 62 and datum surface 34 to the contacting surfaces 46 and 84, and a second part from the other side of the contacting surfaces 46 and 84 to the location L2. In yet another variation the second part can be extended to the location L1 when the protuberances 76 and 48 are spaced apart. Further it is believed that in a further embodiment there may be a continuous gap from between where the datum surface 34 contacts the datum surface 62 all the way to the bottom surface 18.

When the male and female parts are being engaged the male part 12 is first laid on top of a female part 14 so that the protrusion 28 is generally above the recess 56 and the recess 30 is generally above the protrusion 54. The convexly curved surface 47 will rest initially on the convexly curved surface 86. Also the planar surface 46 will be substantially parallel with but slightly aback of the planar surface 84. When applying pressure in a vertical direction on the panel P1 to engage with panel P2 the surface 47 slides along the surface 86. Thus while the protrusion 28 is moving in a generally vertical direction more deeply into the recess 56 it is also being translated in a lateral direction toward the panel P2.

As the downward motion of the male protrusion 28 continues eventually the convex portion 86 on the common female surface 74 enters the recess 44 on the male common surface 42. It will be appreciated that this will result in a lateral translation of the male protrusion 28 away from the panel P2 and the inner most female surface 64. This translation provides a gap or space enabling easier entry of the protrusion 28 into the recess 56 and additionally easier entry of the protrusion 54 into the recess 30.

As the motion of the panels P1 and P2 toward each other continues the recess 44 passes the convex portion 86 so that the male protrusion 28 now commences lateral motion toward the panel P2 bringing the first male and female surfaces 36 and 64 closer together as well as the male and female engagement surfaces 40 and 72 closer together. Eventually the downward motion of the male part 12 into the female part 14 is arrested by the datum surface 34 contacting the datum surface 62. This provides depth control resulting in the surfaces 16 of the panels P1 and P2 being co-planar when the panels P1 and P2 are finally fully joined.

Simultaneous with this at the back end of the joint initially the protuberance 76 sits in the recess 50. Subsequently the protuberance 52 slides over the protuberance 76 and into the recess 78. There after the protuberance 52 engages the protuberance 80 and the protuberance 48 slides under the protuberance 76. This provides the primary vertical locking of the joint system 10*a*. The male protrusion 28 sits in the female recess 56 but the proximal male surface 36 is spaced from the proximal female surface 64 at the front end of the joint system. Thus ordinarily the when the joined panels are in the neutral plane and generally unstressed the front end of the joint system 10*a* does not provide a vertical lock.

From the above description it will be appreciated that when the male and female joints 12 and 14 are being joined while the predominant motion is a vertical motion there is also slight lateral movement toward, away and then again toward each other. This greatly assists in the joining or insertion process. This is particularly beneficial when the panels provided with the male and female joints 12 and 14 are made from a plastic or composite material such as luxury vinyl tile (LVT), wood plastic composite material (WPC), or other plastics/PVC materials. However, it is to be understood that embodiments of the vertical joint system 10 are not limited to such materials. For example other materials from which the panels P may be made include natural timber, manufactured wood, wood laminates, and synthetic materials. The male and female parts 12, 14 can be cut, milled, extruded, or molded, or a combination thereof, into the panels P depending on the materials from which they are made and required manufacturing tolerance.

Once a surface covering for example a floor made from panels joined with a vertical joint system is laid it is subjected to contraction and expansion mainly due to temperature variations. Also forces are applied by the action of people walking on the floor and furniture placed or moving on the floor. A common problem with jointed flooring panels particularly made from plastics material is gapping at the joint and self-disengagement due to the a protrusion rotating out of a recess.

In the present embodiment of the vertical joint system 10 gapping and self-disengagement is attempted to be avoided by the interaction between:

(i) the respective inner most male engagement surface 40 and outer most female engagement surface 72;

(ii) the common male surface 42 and female surface 74; and (iii) the outer most male engagement surface 36 and inner most female engagement surface 64.

The interaction between the inner most male surface 40 and outer most female surface 72 in resisting disengagement arises initially from the contact between the protuberances 52 and 78 at the location L1. This presents the primary vertical disengagement mechanism. Forces which act to vertically separate coupled male and female parts 12, 14 may be initially resisted by the engagement of the surfaces at location L1.

Substantially simultaneously (or shortly thereafter if they are initially spaced apart) the surfaces 40 and 72 increase their contact against each other at the second location L2. This is also believed to causes a re-direction of the separating force in a plane perpendicular to the tangent plane T2 tending to close or at least resist the widening of the recess 56.

Finally depending on the magnitude on the force acting to cause vertical separation the interaction between the outermost male engagement surface 36 and the inner most female engagement surface 64 commences. In particular the nib 38 will engage the lower most recess 70 in response to any upward motion or rotation. This in itself creates fiction to arrest any further displacement. However should this occur then the nib 38 can successively engage in the recess 68 and thereafter the recess 66. Such engagements again add frictional force resisting separation of the engaged male and female parts 12 and 14.

However the joint 10*a* is designed to be able to be disengaged (for example for the purposes of repair of a floor covering) by application of a force in a direction perpendicular to the upper surface 16 and away from the lower surface 18. This is opposite to the direction of force required for the coupling of the joint system 10*a*. This is explained later with reference to FIGS. 7*a*-7*k*.

FIGS. 1*a* and 1*b* shows the adaptability of the present system 10*a* for surface covering panels P of various thicknesses. For example the system 10*a* could be used for panels of thickness in the range of, but not limited to say 5 mm-7 mm. In FIG. 1 the distance AB may be 5 mm; AC 5.5 mm; AD 6 mm; DF 6.5 mm and EF 7 mm. However other thickness ranges are also possible such as 3 mm-7 mm.

The joint system 10*a* has been described above in terms of a male part 12 with a protrusion 28 and recess 30 and a female part 14 with a protrusion 54 and a recess 56. However the vertical joint system 10*a* can also be descried in terms of vertically engageable locking parts on at least two opposed sides of a panel P, the locking parts having proximal mutually receivable components near an edge of the upper surface of the panel P in which the vertical joint system 10*a* is provided, and distal mutually receivable components near an edge of the lower surface of the panel P. The proximal mutually receivable components are exemplified by and may have all the features of the male protrusion 28 and the female recess 56 described in relations to all of the presently disclosed embodiments. Both of these components are near the edge of the upper surface 16 of the panel in which the joint system 10*a* is formed. The distal mutually receivable components are exemplified by and may have all the features of the male recess 30 and the female protrusion 54 described in relations to all of the presently disclosed embodiments. Both of these components are near the edge Y of the lower surface 18 of the panel in which the joint system 10*a* is formed. The proximal components being the protrusion 28 and the recess 56 are formed on opposite sides of the same panel P. Likewise the distal components being the protrusion 54 and the recess 30 are formed on opposite sides of the same panel P.

When the joint system 10*a* is viewed as such proximal and distal mutually receivable components then it is also apparent that the components are configured so that when the respective locking parts of two panels with the same vertical locking system are engaged, the surface 72 on a side of one of the distal components 54 nearest the lower surface 18 overlies a surface 40 on a side of the other distal component 30 nearest the lower surface 18 at a first location L1 and a second location L2. All the full functionality and characteristic of the male and female parts 12, 14 apply to the system 10*a* when described in terms of the proximal and distal mutually receivable components; including for example the angular relationship between parts of the surfaces at the locations L1 and L2.

Figure 3:
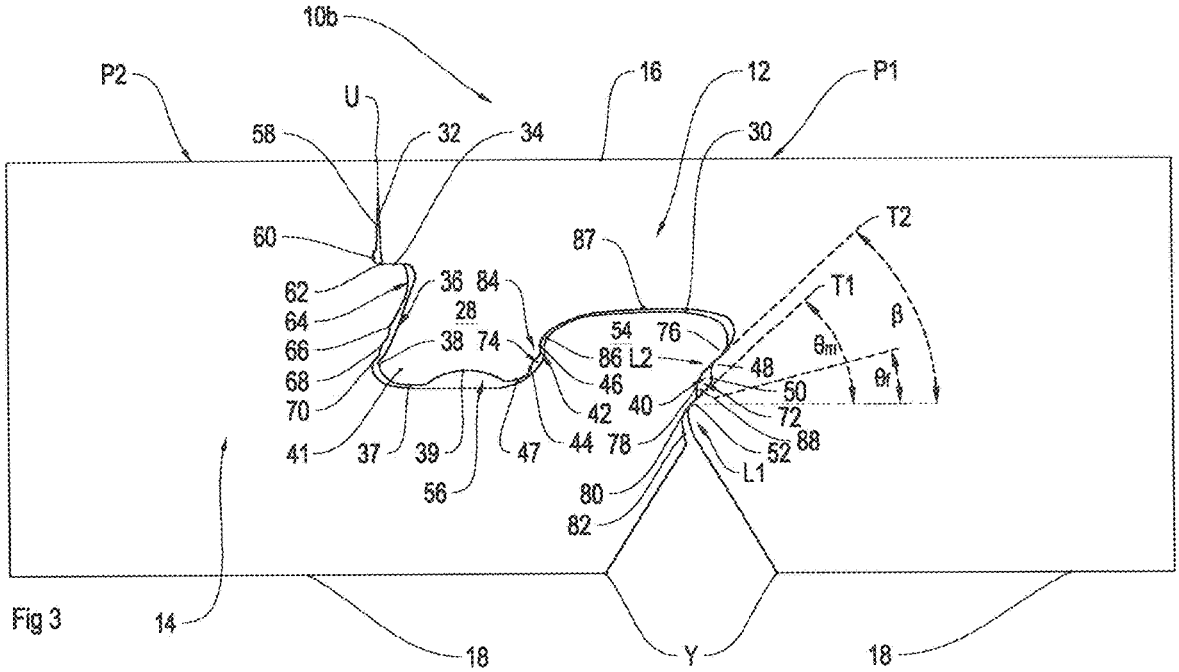
FIG. 3 is a schematic representation of two mutually engaged surface covering panels each having a second embodiment of the disclosed vertical joint system.

FIG. 3 depicts a second embodiment of the vertical joint system 10*b*. In describing and illustrating the joint system 10*b* the same reference number are used to denote the same feature as in the joint system 10*a*. The joint system 10*b* only differs from the joint system 10*a* in the shape and configuration of the protuberance 80 on the outer most (distal) female surface 72 at the location L1. Specifically the protuberance 80 has a surface portion 81 that lies in a tangent plane T1*f* that is parallel to the tangent plane T1*m*, i.e. $\theta_f°=\theta_m°$. Therefore when the protuberances 80 and 52 contact each other the tangent planes are coincident.

Figure 4:
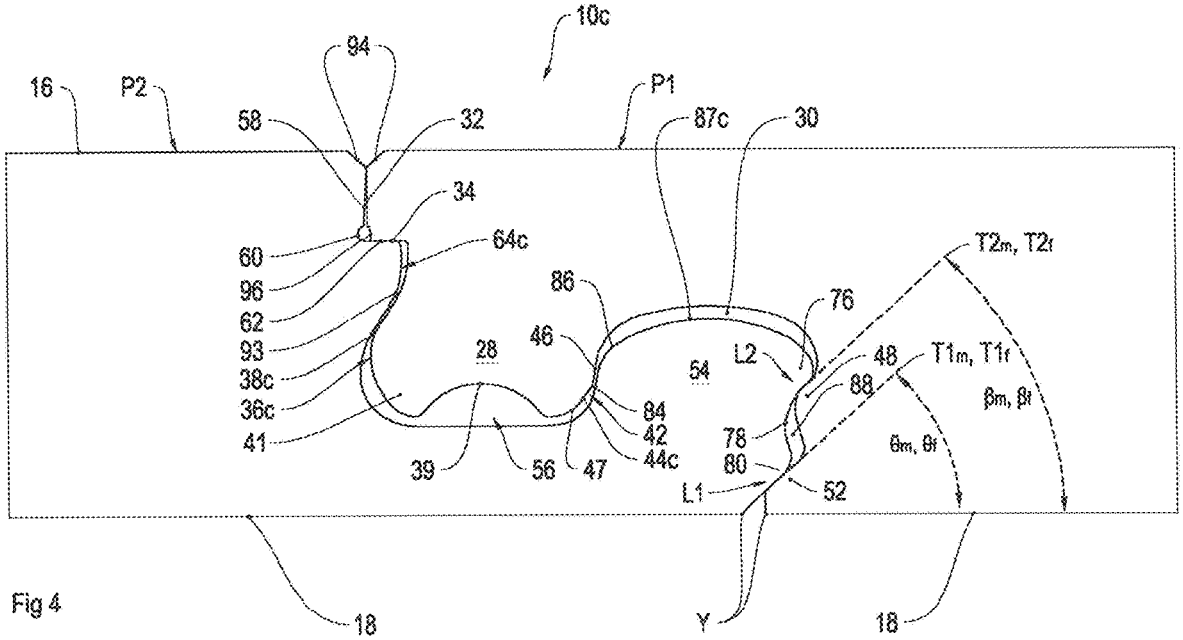
FIG. 4 is a schematic representation of two mutually engaged surface covering panels each having a third embodiment of the disclosed vertical joint system.

FIG. 4 depicts a third embodiment of the vertical joint system 10*c*. In describing and illustrating the joint system 10*b* the same reference number are used to denote the same feature as in the joint system 10*a* and 10*b*; however for ease of distinction features which differ are provided with the suffix "c". The joint system 10*c* only differs from the joint system 10*b* in:

- The shape and configuration of the inner most (proximal) female surface 64*c*. The surface 64*c* omits the recess 66, 68, and 70 and is formed with a greater concavity near the bottom of the recess 56.
- The shape and configuration the outer most (proximal) male surface 36*c* which is provided with a more pronounced convex curve but with a slight nib 38*c* just over about halfway down from the datum surface 34. The nib 38*c* acts in a similar way to the nib 38 of the systems 10*a* and 10*b* which is omitted from the joint system 10*c*. In particular in response to peaking of the panels P1 and P2 the nib 38*c* will eventually contact the surface 64*c* and provide additional resistance to vertical separation.
- The replacement of the concavity 44 which is provided on the common male surface 42 of the joint systems 10*a* and 10*b* with a slightly curved and indeed almost planar portion 44*c*.
- The provision of a small taper 94 at the upper the edge U when the panel at the edge of the joints.
- The inclusion of a small recess 96 at the bottom of surface 32. This provides relief for engagement and minimizes the risk of a corner burr which may form during manufacture preventing full seating of the surfaces 32 and 34 on surfaces 58 and 62 respectively.
- A more pronounced convex curvature on the top surface 87*c* of the female protrusion 54*c*.

Figure 5:
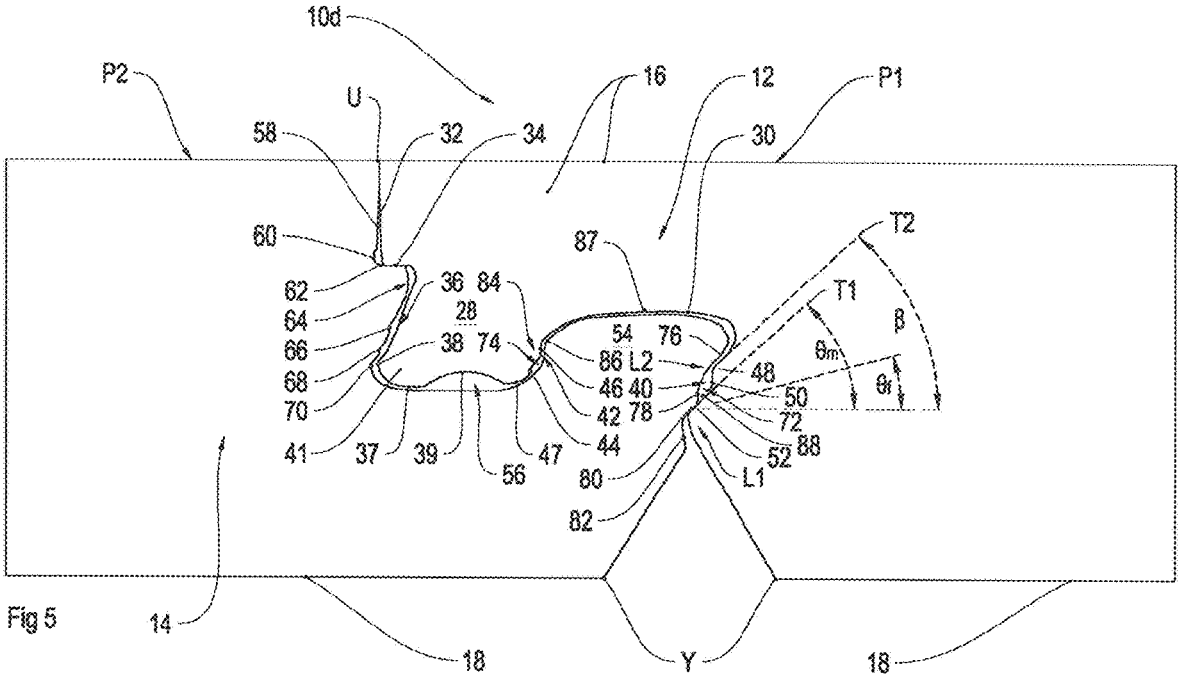
FIG. 5 is a schematic representation of two mutually engaged surface covering panels each having a fourth embodiment of the disclosed vertical joint system.

FIG. 5 depicts a fourth embodiment of the vertical joint system 10*d*. In describing and illustrating the joint system 10*d* the same reference number are used to denote the same feature as in the joint system 10*a*. The joint system 10*d* only differs from the joint system 10*a* in the relative dimensioning of the protrusion 54 and recess 30 so that at location L2 the protuberances 48 and 76 are spaced apart when the joint is in the neutral plane. Thus there is a gap or space between the male and female joints 12, 14 all of the way from where the datum surface 34 contacts the datum surface 62 to the location L1.

Figure 6:
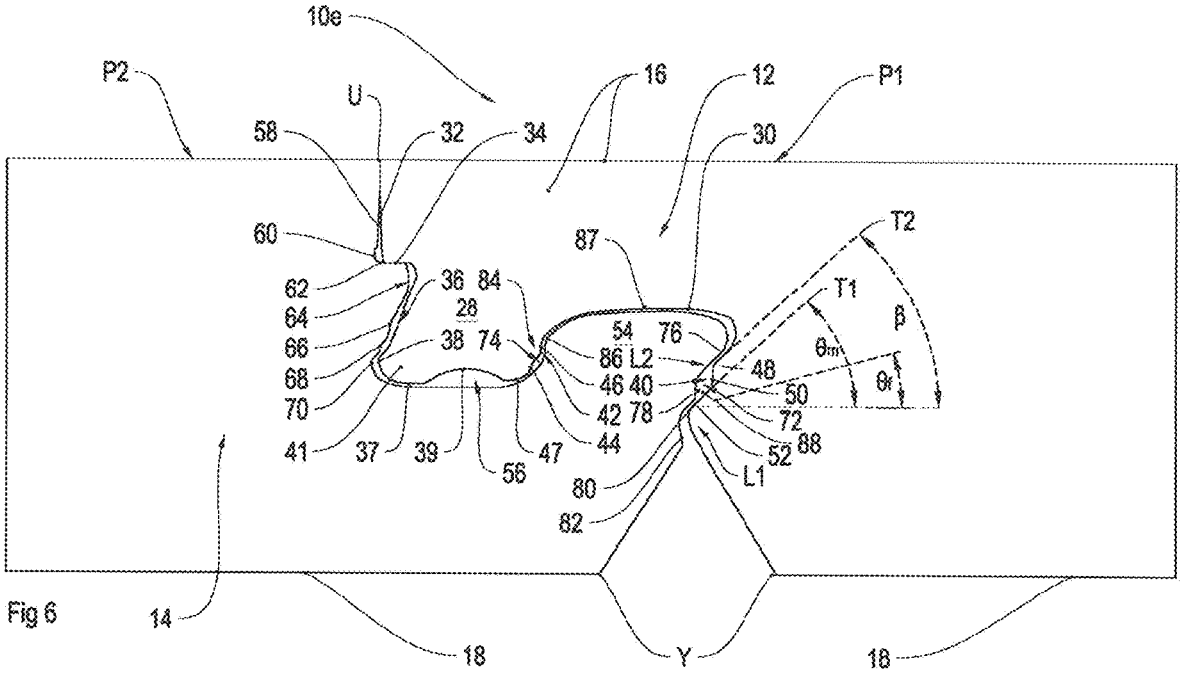
FIG. 6 is a schematic representation of two mutually engaged surface covering panels each having a fifth embodiment of the disclosed vertical joint system.

FIG. 6 depicts a fifth embodiment of the vertical joint system 10*e*. In describing and illustrating the joint system 10*e* the same reference number are used to denote the same feature as in the joint system 10*a*. The joint system 10*e* only differs from the joint system 10*a* in the relative dimensioning of the protrusion 54 and recess 30 so that at locations L1 and L2 the protuberances 48 and 76; and 52 and 80; are spaced apart when the joint is in the neutral plane. Thus there is a gap or space between the male and female joints 12, 14 all of the way from where the datum surface 34 contacts the datum surface 62 to the lower surface 18. In this embodiment gravity alone holds the datum surface 34 on the datum surface 62. Thus the engaged joint has a small degree of lateral play. This may assist in engaging the male joint with the female joint and minimizing stress and tension in the joint when in the neutral plane and in the absence of other forces. However if for example a lateral compressive force is applied through the floor that may tend to give rise to peaking that force will also cause abutment of the distal male and female surfaces 40 and 72 which would then act to resist vertical separate and further peaking.

Broadly some embodiments of the disclosed vertical joint system may be described as follows:

a vertical joint system 10*a*, 10*b*, 10*c*, 10*d* for a surface covering panel P having an upper surface 16 which is visible when the surface covering is laid and an opposed lower or under surface 18 with a plurality of sides 20, 22, 24, 26 (see FIG. 2) located between the upper and under surfaces 16, 18, the vertical joint system 10*a*, 10*b*, 10*c*, 10*d*, comprising:

a male part 12 along a first of the sides 20 or 24;

a female part 14 along a second of the sides 22 or 26, the second side being opposite to the first side;

the male and female parts 12, 14 being configured so that when the male part of one surface covering panel P1 is engaged with a female part of a second surface covering panel P2 to create an engaged joint having a proximal end near respective upper edges U of upper surfaces 16 of the panels P1, P2 and a distal end near respective lower edges Y of lower surfaces 18 of the panels P1, P2:

(a) at the proximal end of the engaged joint the male part 12 rests on the female part 14 on a datum surface 62 defining a datum plane controlling a depth of insertion of the male part 12 in the female part 14 so that the upper surfaces 16 of the panels P1, P2 are co-planar; and (b) at the distal end of the engaged joint the male part 12 at contacts on overlying portion of the female part 14 to hold the male and female parts together at the datum plane 62.

The embodiment for the joint system 10*e* differs from the above only in relation to the feature at paragraph (b) where instead for the joint system 10*e*, at the distal end of the engaged joint the female part overlies the male part in at least one location L1 and/or L2; and there is a continuous gap is formed between the male and female part from the datum plane 62 to the lower surface 18 of the panels P1, P2. Thus there is no contact at L1 or L2 with the embodiment of vertical joint 10*e*.

In the above embodiments of joint systems 10*a*, 10*b*, 10*c* and 10*d* the male and female parts 12, 14 may be configured so that in the engaged joint a continuous gap is formed between the male part 12 and female part 14 from the datum surfaces 34, 62 to where the male part 12 contacts on overlying portion of the female part 14 such as for example at location L1 or L2. Although as previously described there can be two continuous gaps, one from the datum surfaces 34, 62 to an intermediate location where the common surface portions 42 and 74, and a second from the intermediate location to location L1 or L2.

Figure 7B:
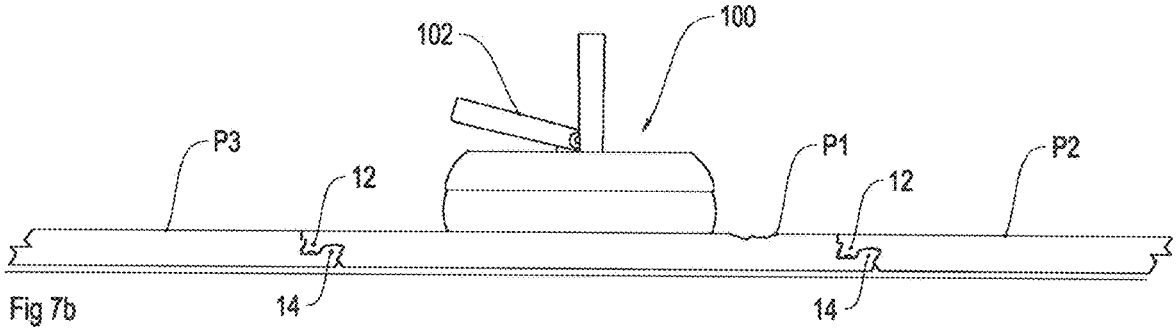

FIG. 7*a* shows a plan view of a damaged panel P1 in a floor and joined to panels P2, P3, P4, P5, P6 and P7. FIGS. 7*b*-7*k* illustrate a sequence of steps for replacing the damage panel P1 when viewed along section AA of FIG. 7*a* when the panel P1 is made of a plastics or pliable material. The panels have the embodiment of the joint system 10*a*, but irrespective of the specific embodiment of the joint system the sequence of steps remains the same. This sequence is as follows:

A suction cup 100 is placed on panel P1 near its transverse end 24. (FIGS. 7*a* and 7*b*)

Figure 7C:
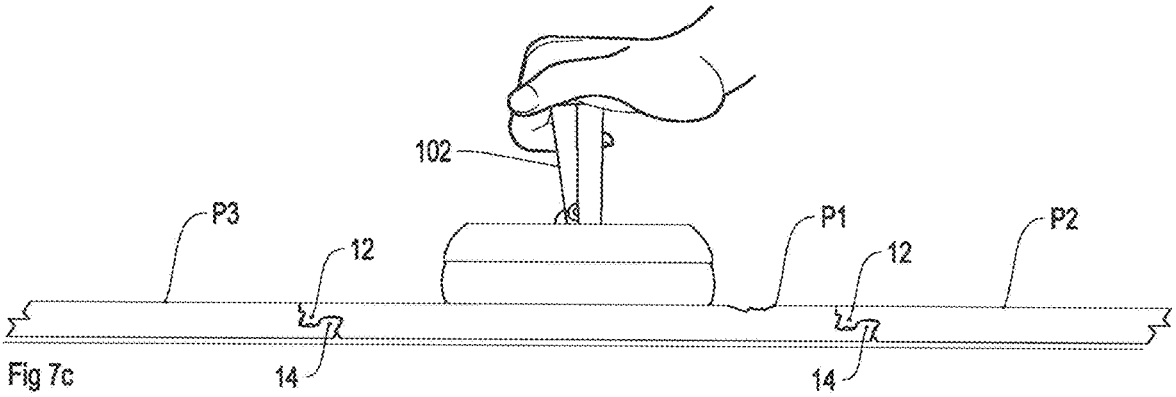

The suction cup 100 is activated by lifting of a lever 102 so that the suction cup 100 grips the end of the panel P1 (FIG. 7*c*).

Figure 7D:
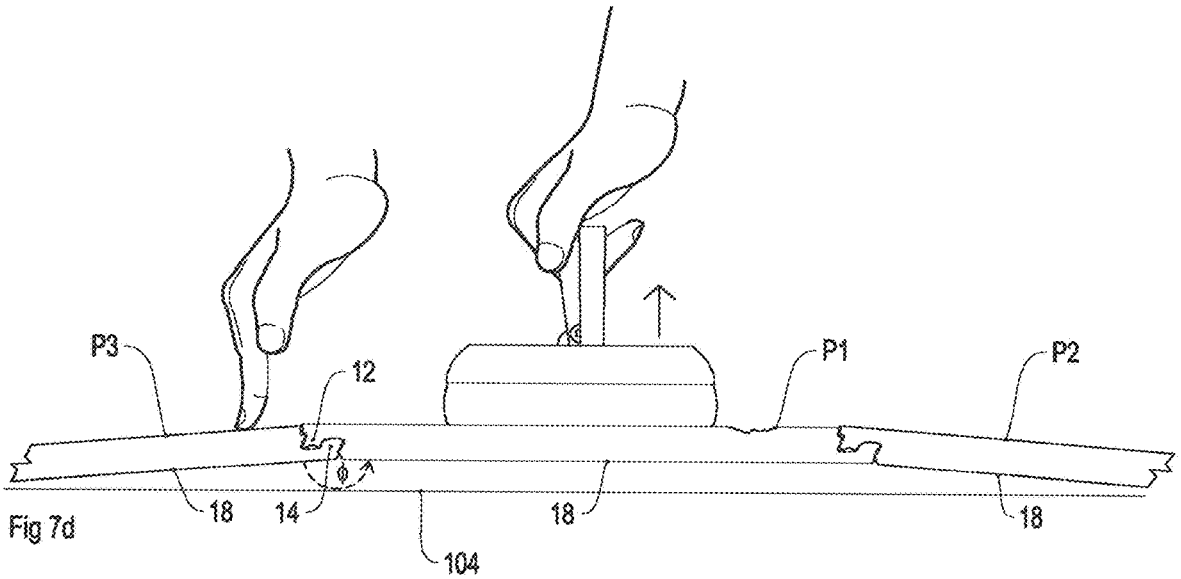

With reference to FIG. 7*d*, a person pulls upwardly on the suction cup 100 lifting the panel P1 from an underlying substrate 104. The end of the panel P1 is lifted to be substantially parallel to the substrata 104 and the panels P2 and P3 are inclined downwardly from the sides of the panel P1. This is accommodated by a relative rotation of the male and female joints 12, 14 on each side. This rotation initially causes: (a) an increase in the contact pressure between the distal male and female surfaces 40, 72 with the protuberance 52 sliding further under protuberance 80; and (b) the protrusion 28 to rotate clockwise within recess 56 causing the proximal surfaces 36 and 64 to contact each other.

More particularly the nib 38 starts to ride up the surface 64, the datum surface 34 lifts off the datum surface 62 and the upper edge U of panel P1 adjacent panel P3 is now above the upper edge of the panel P3, while upper edge U of panel P1 adjacent panel P2 is now below the upper edge of the panel P2. With increased lift of the panel P1 the angle $\phi$ of rotation between the lower surfaces 18 of P1 and P3 on one side and P1 and P2 on the other side the nib 38 rides up the surface 64 to reside in upper most recess 66 (for joint system 10*a*, 10*b*, 10*d* and 10*e*). For the system 10*b* an equivalent location is where the nib 38*c* reaches the part 93 of surface 64*c* where it commences to concavely curve. The angle $\phi$ may be in the range of about 175°-165°. The protrusion 28 is now primed for release from the recess 56.

Figure 7E:
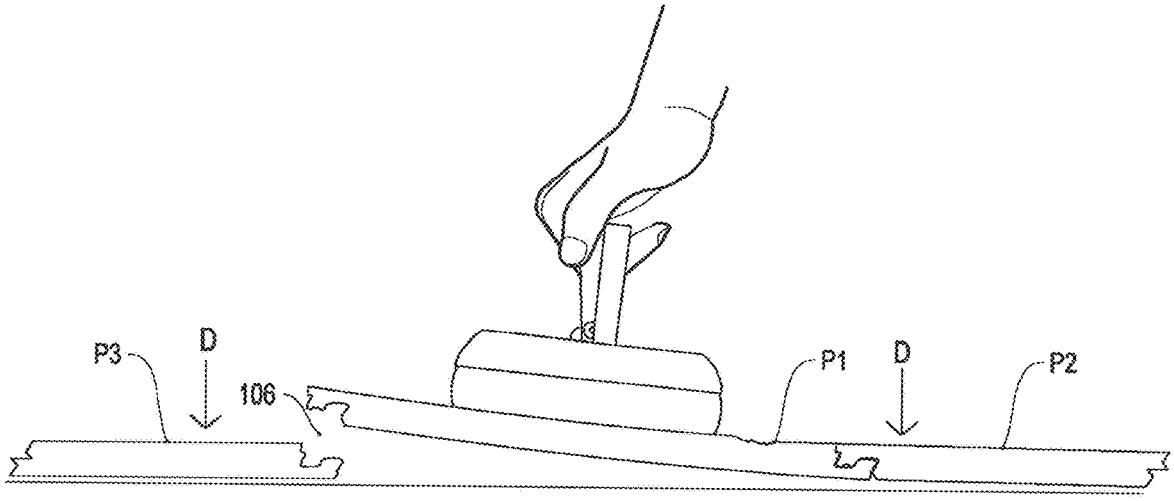

Referring to FIG. 7*e*, while the panels are in the state shown in FIG. 7*d*, the person holding the suction cup 100 pushes down on the panels P2 and P3 one at a time as depicted by arrows D. The one of these panels with having its female joint 14 engaged with panel P1 will disengage. The person holding the suction cup 100 will not know beforehand that this is panel P3. This will only be found by pushing down on both P2 and P3 to see which one disengages in response to the push. This push on the panel P3 will cause the nib 38/38*c* to ride further up the surface 64/64*c* releasing the protrusion 28 from the recess 56. There is now either no or very minor resistance to relative lateral motion of the joints 12 and 14 which enables, with minimal force and effort, the distal surfaces 40 and 72 to separate and for the protrusion 54 to release from the recess 30. Thus in summary pushing down on panel P3 near its edge with panel P1 snaps the protrusion 28 of panel P1 from the recess 56 of panel P3 and the protrusion 54 of panel P3 from the recess 30 panel P1. This occurs in the vicinity of the application of the push and provides an opening 106 into which the person can insert one or more fingers.

Figure 7F:
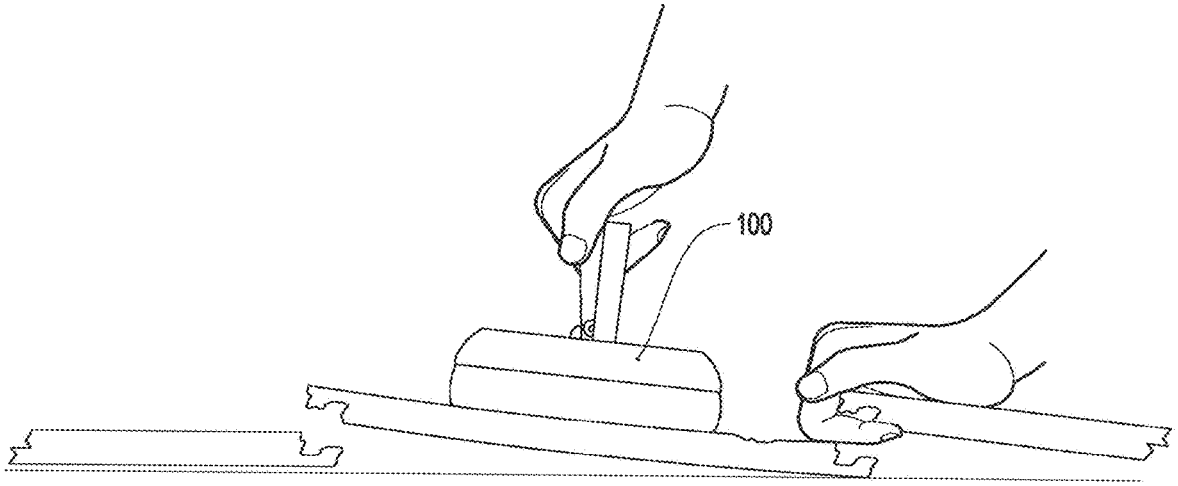
Figure 7G:
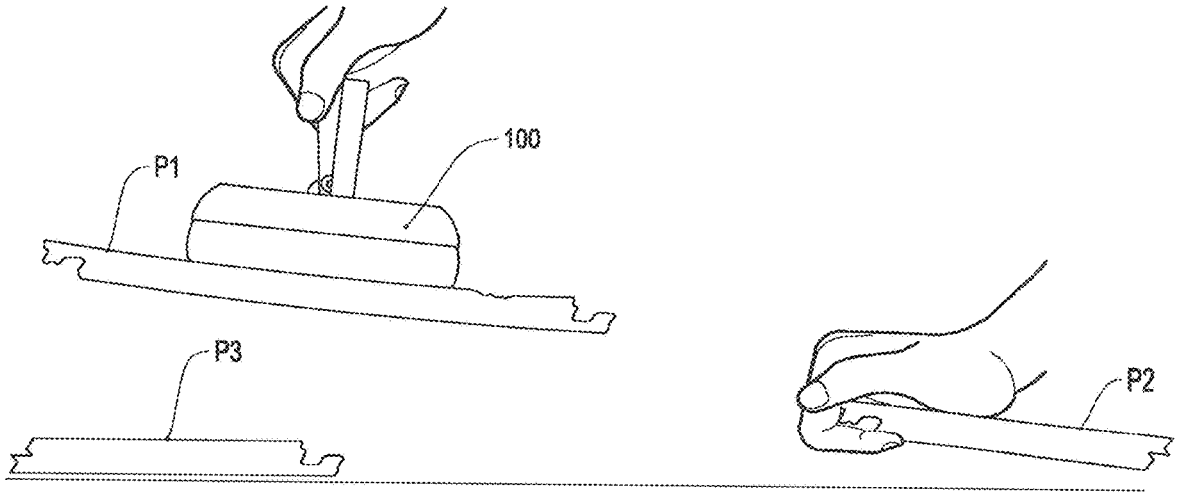
Figure 7H:
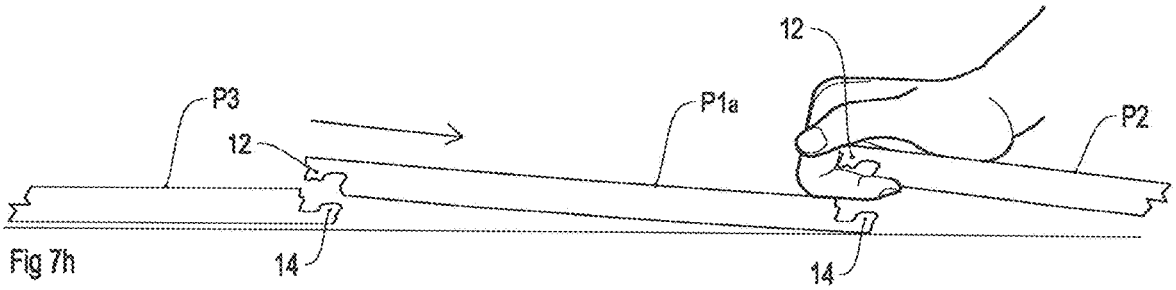
Figure 7I:
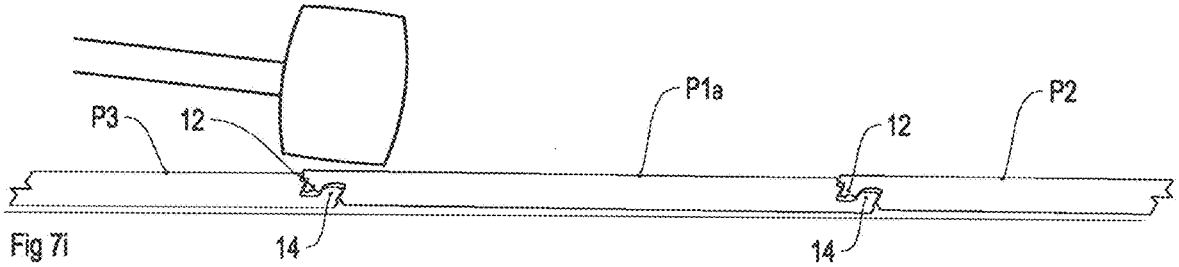
Figure 7J:
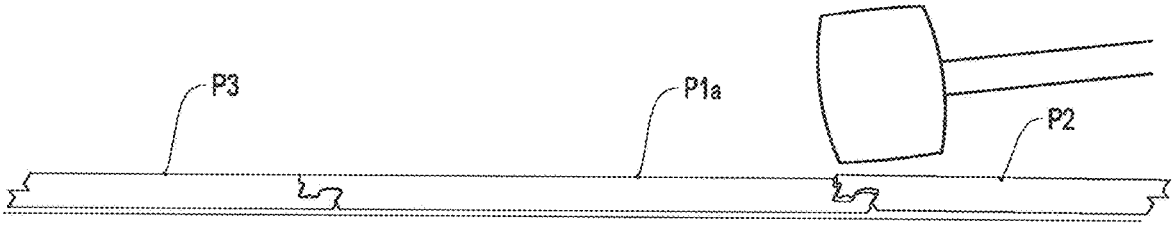
Figure 7K:
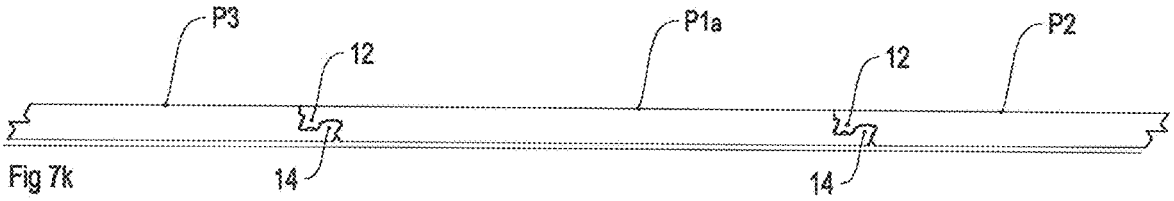

From here the person can now in effect unzip the engaged joints 12, 14 for the entirety of the perimeter of the panel P1. With reference to FIG. 7*k* the user can chase their finger(s) around the transverse side 24 of panel P1 as shown by the path 108. By either pulling up or pushing down on the panel P4 (depending on whether the panel P4 has its male or female joint adjacent the side 24) using the hand having the fingers previously inserted in the opening 106, the joints along the side 24 now become disengaged.

Following the path 108 around to the panel P2 the person can pull the male joint 12 of panel P2 from the female joint on the adjacent side of the panel P1. (FIG. 7*f*)

The person continues chasing their fingers and hand about the panel P1 to fully disengage panel P1 from panels P2, P6, P5, P7 and P3; pushing down or pulling up depending on whether the joint on those panels is the male joint 12 or the female joint 14. The fully disengaged panel P1 is now discarded. (FIG. 7*g*).

A new panel P1*a* is inserted into the space left by the discarded panel P1. In doing so the panel P1*a* is manipulated so that its female joints 14 along sides 22 and 26 are placed beneath the male joints 12 of the adjacent panels P2, P6 and P5; and its male joints 12 on sides 20 and 22 overlie the female joints 14 of panels P3, P4 and P7. (FIG. 7*h*)

A mallet 110 is now used to apply a vertical downward force along the mutually overlying male and female joints 12, 14 tapping about the perimeter of panel P1*a*. (FIGS. 7*i* and 7*j*)

The surface covering of (e.g. floor on) substrate 104 is now reinstated as shown in FIG. 7*k*.

It should be noted that the above description of replacement of the panel P1 is performed without the need to cut a corner of the panel P1*a* which is the practice with plastics panels having prior art joints particularly with tongue and groove lay-down joints. This practice is dangerous due to the use of very sharp knives (e.g. a box cutter) and also regularly results in the unintentional cutting of an otherwise undamaged panel. In that event a further panel needs to be replaced. Also the removal process does not cut or damage the vertical joints system 10 on the other panels. This enables the replacement panel P1*a* to be coupled to all of the surrounding panels P2-P7 by coupling of the respective male and female joints, without the need for adhesives and enabling the full reinstatement of the surface covering.

Whilst specific embodiments of the vertical joint system have been described it should be appreciated that the vertical joint system may be embodied in many other forms. For example while the panels P are describes as being of rectangular shape, they may take other polygonal shapes. Also the panels are not limited in use as floor covering panels. They may be used to cover other surfaces such as walls or ceilings. In one example the panels can be arranged as a wall covering without needing to be adhered to a wall by first fixing a rail along the top of the wall, fixing a first panel or line of end to end joined panels to the rail then using embodiments of the disclosed joint system to coupled subsequent rows of panels to cover the wall. This produces a suspended wall covering. Avoiding the use of adhesives eliminates damage to the underlying wall in the event that the wall covering is to be subsequently removed or replaced.

FIG. 2 shows an embodiment where the joints system 10 provides male and female parts 12, 14 on each of two sides of the panel so as to form a fully vertically engageable and disengage able surface covering system. However the joint system 10 may be applied to only two sides and in particular to the short sides 24 and 26, with laterally extending tongue and groove type joints on the other sides 20 and 22. This results in a laydown surface covering system with the joint system 10 providing a "drop lock" on two (usually the short) sides only.

In other modifications or variations the panels may be provided with adhesive and preferably a re-stickable adhesive on the lower surface. The expression "re-stickable adhesive" throughout the specification and claims is intended to mean adhesive which is capable of being able to be removed and re-adhered, does not set or cure to a solid rigid mass and maintains long term (e.g. many years) characteristics of flexibility, elasticity and stickiness. The characteristic of being re-stickable is intended to mean that the adhesive when applied to a second surface can be subsequently removed by application of a pulling or shearing force and can subsequently be reapplied (for example up to ten times) without substantive reduction in the strength of the subsequent adhesive bond. Thus the adhesive provides a removable or non-permanent fixing. The characteristics of flexibility and elasticity require that the adhesive does not solidify, harden or cure but rather maintains a degree of flexibility, resilience and elasticity. Such adhesives are generally known as fugitive or "booger" glues and pressure sensitive hot melt glues. Examples of commercially available adhesives which may be incorporated in embodiments of the present invention includes, but are not limited to: SCOTCH-WELD™ Low Melt Gummy Glue; and GLUE DOTS™ from Glue Dots International of Wisconsin.

Also panels, particularly those made of plastics or polymer materials, provided with embodiments of the disclosed joint system 10*a*, 10*b* may be used as a substrate for another "face" panel such as but not limited to: ceramic tiles; natural stone tiles; metal panels; glass tiles and sheets; fiber cement tiles, boards or panels; and carpet tiles. Specifically such face panels can be permanently fixed to the underlying panels (substrates) to form a laminate product. This enables for example the installation of a floor that has the look and feel of a stone or ceramic tile floor but with the ability to easily replace a damaged tile in the same manner as described above in relation to the floor panels P. The face panels may also bear printed or sprayed on coating. For example a metal or fibre cement face panel may have a printed or sprayed on coating or surface decoration. In such embodiments a layer of reinforcing material such as a fiber reinforced composite material may be sandwiched between the substrate and the face panel to enhance rigidity. This may be beneficial for example where the face panel is made of a brittle material such as stone, ceramic or glass to assist in preventing cracking.

The surfaces 46 and 84 are described in this embodiment as being substantially perpendicular to the upper surface 16. However in other embodiments they may be inclined up to about 20° in the same direction as the angles θ and β, i.e. so that when inclined the surface 46 overlies the surface 86.

Further the ability of the male part 12 to move laterally toward, away from and then again toward an adjoining panel during the insertion process which facilitates ease of insertion may be achieved by in effect reversing the configuration of the male and female common surfaces 42 and 74 so that the convex portion 86 of the female protrusion 54 is replaced by a concave recess similar to the recess 42 while the recess 42 on the male protrusion 28 is in effect filled in so that the concave surface 47 extends continuously to the planar surface 46.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in variations or embodiments of the joint system disclosed herein.

The invention claimed is:

1. A vertical joint system for a plurality of surface covering panels, wherein each surface covering panel has an upper surface which is visible when a surface covering is laid, an opposed lower surface, and a plurality of sides located between the upper and lower surfaces, the vertical joint system comprising:

a first locking part along a first of the sides;

a second locking part along a second of the sides, the second side being opposite to the first side, and the first and second locking parts being vertically engageable with one another;

the second locking part having a second protrusion that extends from the lower surface toward the upper surface and a second outer most surface on the second protrusion;

the first locking part having a first recess that opens onto the lower surface, a portion of the first recess forming a first inner most surface;

wherein the second outer most surface and the first inner most surface are arranged so that when the first locking part of one surface covering panel is engaged with a second locking part of a second surface covering panel the second outer most surface overlies the first inner most surface at a first location and a second location;

wherein the second locking part has a datum surface on which the first locking part bears when the first and second locking parts of respective vertical joint systems are arranged, the datum surface providing a depth control for the first locking part when inserted into the second locking part;

wherein the second locking part has a second recess adjacent the second protrusion, and the second recess has a second inner most surface distant the second protrusion;

wherein the first locking part has a first protrusion, and a first common surface that lies on both the first protrusion and the first recess;

wherein the second locking part has a second common surface that lies on both the second protrusion and the second recess; and wherein the vertical joint is configured so that when the first and second locking parts of respective vertical joint systems are coupled together with the respective lower surfaces in a common plane, a continuous gap is provided between a second inner most surface and a first outer most surface from the datum surfaces to at least the first common surface.

2. The vertical joint system according to claim 1, wherein in at least one of the first and second locations the second outer most surface and the first inner most surface contact each other when the lower surfaces of two joined like panel lie in a common plane.

3. The vertical joint system according to claim 2, the second outer most surface and the first inner most surface contact each other at the first location and wherein the first location is closer to the lower surface than the second location.

4. The vertical joint system according to claim 1, wherein the second location overhangs the first location.

5. The vertical joint system according to claim 1, wherein the second outer most surface adjacent the first region of contact and on a side nearest the bottom surface is generally inclined at an angle $\theta_f°$, wherein the angle $\theta_f°$ is less than the angle $\theta_m°$.

6. The vertical joint system according to claim 5, wherein the angle $\theta_f°$ is about 15° to a plane parallel to the upper surface.

7. The vertical joint system according to claim 1, wherein the first inner most surface at the first location has a first surface portion with a first tangent plane at a first region of contact with the second outer most surface that is inclined at an angle $\theta_m°$ in the range of about 15° to 75° to a plane parallel to the upper surface.

8. The vertical joint system according to claim 7, wherein the angle $\theta_m°$ is about 45° to a plane perpendicular to the upper surface.

9. The vertical joint system according to claim 7, wherein the first surface portion is:

a surface portion of a generally convex protuberance; or a planar surface portion.

10. The vertical joint system according to claim 1, wherein first inner most surface at the second location has a second surface portion with a second tangent plane at a second region of contact with the second outer most surface that is inclined at an angle $\theta_m°$ in the range of about 15° to 75° to a plane parallel to the upper surface.

11. The vertical joint system according to claim 10, wherein the second tangent plane is inclined at the angle $\theta_m°$ of about 45° to the plane parallel to the upper surface.

12. The vertical joint system according to claim 10, wherein at the second location the second outer most surface at the second region of contact with the first inner most surface has a surface portion lying in the second tangent plane.

13. The vertical joint system according to claim 1, wherein:

the first protrusion is adjacent to the first recess with the first outer most surface formed on the first protrusion distant the first recess; and the second inner most surface overlies the first outer most surface.

14. The vertical joint system according to claim 13, wherein:

the second inner most surface is provided with a series of contiguous recesses and the first outer most surface is provided with a nib;

the second inner most surface and the first outer most surface configured so that when the first locking part is fully engaged with the second locking part the nib resides in a lowest one of the contiguous recesses; and in response to a relative rotation or uplift of the first locking part relative to the second locking part the nib can enter respective higher recesses sequentially to provide resistance to the withdrawal of the first protrusion from the second recess.

15. The vertical joint system according to claim 1, wherein the first protrusion of the one surface covering panel is configured to be laterally displaced toward and then away from the second surface covering panel during vertical displacement of the first protrusion of the one surface covering panel into the second recess of the second surface covering panel for locking of the one surface covering panel and the second surface covering panel.

* * * * *